US010219574B2

(12) United States Patent
Lee

(10) Patent No.: US 10,219,574 B2
(45) Date of Patent: Mar. 5, 2019

(54) MECHANICAL-WAVES DISSIPATING PROTECTIVE HEADGEAR APPARATUS

(71) Applicant: Choon Kee Lee, Denver, CO (US)

(72) Inventor: Choon Kee Lee, Denver, CO (US)

( * ) Notice: Subject to any disclaimer, the term of this patent is extended or adjusted under 35 U.S.C. 154(b) by 0 days.

(21) Appl. No.: 15/194,240

(22) Filed: Jun. 27, 2016

(65) Prior Publication Data

US 2017/0367431 A1 Dec. 28, 2017

(51) Int. Cl.

| | |
|---|---|
| ***A42B 3/00*** | (2006.01) |
| ***A42B 3/12*** | (2006.01) |
| ***A42B 3/28*** | (2006.01) |
| ***A42B 3/06*** | (2006.01) |

(52) U.S. Cl.

CPC ..... *A42B 3/122* (2013.01); *A42B 3/063* (2013.01); *A42B 3/069* (2013.01); *A42B 3/283* (2013.01)

(58) Field of Classification Search

CPC ..... A42B 3/324; A42B 3/064; A42B 3/283; A42B 3/069; A63B 71/10

USPC ..... 2/422, 421

See application file for complete search history.

(56) References Cited

U.S. PATENT DOCUMENTS

| | | | | | |
|---|---|---|---|---|---|
| 1,833,708 | A | | 1/1931 | Ford | |
| 2,150,290 | A | | 10/1937 | Mulvey | |
| 2,343,408 | A | * | 3/1944 | Glass | A41D 31/02 2/181 |
| 2,618,780 | A | | 7/1950 | Cushman | |
| 3,462,763 | A | | 8/1969 | Schneider | |
| 3,872,511 | A | * | 3/1975 | Nichols | A42B 3/121 2/413 |
| 4,014,048 | A | * | 3/1977 | Rappleyea | A42B 3/122 137/223 |
| 4,324,005 | A | | 4/1982 | Willis | |
| 4,432,099 | A | | 2/1984 | Grick | |
| 4,586,200 | A | | 5/1986 | Poon | |
| 5,014,365 | A | | 5/1991 | Schulz | |
| 5,129,107 | A | * | 7/1992 | Lorenzo | A42B 1/203 2/413 |
| 5,181,279 | A | | 1/1993 | Ross | |
| 5,204,998 | A | | 4/1993 | Liu | |
| 5,263,203 | A | | 11/1993 | Kraemer | |
| 5,720,051 | A | | 2/1998 | Johnson | |
| 5,815,846 | A | | 10/1998 | Calonge | |
| 5,890,232 | A | | 4/1999 | Park | |
| 6,219,850 | B1 | | 4/2001 | Halstead | |
| 6,272,692 | B1 | * | 8/2001 | Abraham | A42B 3/063 2/411 |
| 6,434,755 | B1 | | 8/2002 | Halstead | |

(Continued)

*Primary Examiner* — Timothy K Trieu

(57) ABSTRACT

The present invention provides an apparatus to dissipate and attenuate mechanical waves which travel through a human brain upon blunt trauma. The apparatus comprises a pressurizable and ventable outer balloon shell encasing an inner hard shell. The pressurizable and ventable outer balloon shell is configured to release a pressurized gas to the atmosphere upon an impact to said pressurizable and ventable outer balloon shell. The apparatus is configured to enhance efficiency in reduction of an amplitude of the mechanical waves of the blunt trauma delivered to the human brain and to disrupt doubling-up of mechanical waves in a pressure zone inside the pressurizable and ventable outer balloon shell. The apparatus is configured to ventilate the pressurizable and ventable outer balloon shell and the inner hard shell.

15 Claims, 13 Drawing Sheets

(56) References Cited

U.S. PATENT DOCUMENTS

| | | | | |
|---|---|---|---|---|
| 6,681,408 | B2 * | 1/2004 | Ku | A42B 3/122 2/411 |
| 7,089,602 | B2 | 8/2006 | Talluri | |
| 7,254,843 | B2 | 8/2007 | Talluri | |
| 8,156,570 | B1 * | 4/2012 | Hockaday | A41D 13/0025 2/7 |
| 8,196,226 | B1 | 6/2012 | Schuh | |
| 8,528,119 | B2 | 9/2013 | Ferrara | |
| 8,713,716 | B2 | 5/2014 | Krueger | |
| 8,732,868 | B2 | 5/2014 | Ellis | |
| 8,756,719 | B2 | 6/2014 | Veazie | |
| 8,814,150 | B2 | 8/2014 | Ferrara | |
| 8,844,066 | B1 * | 9/2014 | Whitcomb | A42B 3/121 2/413 |
| 8,950,735 | B2 | 2/2015 | Reynolds | |
| 8,966,669 | B2 | 3/2015 | Hines | |
| 9,113,672 | B2 | 8/2015 | Witcher | |
| 9,173,445 | B1 | 11/2015 | Whitcomb | |
| 9,820,524 | B1 * | 11/2017 | Whitcomb | A42B 3/122 |
| 2007/0190293 | A1 * | 8/2007 | Ferrara | B29C 45/0053 428/166 |
| 2012/0266366 | A1 | 10/2012 | Ferrara | |
| 2013/0283506 | A1 | 10/2013 | Archbold | |
| 2014/0068841 | A1 | 3/2014 | Brown | |
| 2014/0123371 | A1 | 5/2014 | Witchewr | |
| 2015/0008085 | A1 | 1/2015 | Ferrara | |
| 2015/0107005 | A1 | 4/2015 | Schneider | |
| 2015/0223545 | A1 | 8/2015 | Fraser | |

* cited by examiner

20

21

10
22
23
8
9

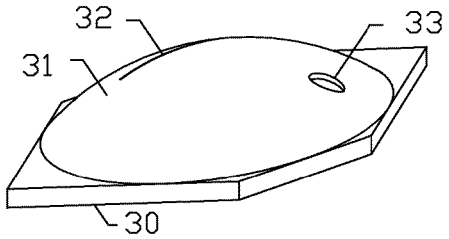
FIG. 10A
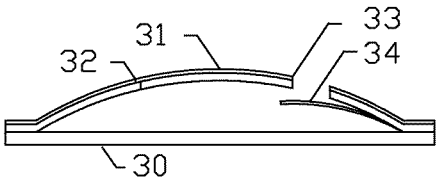
FIG. 10B
FIG. 10D
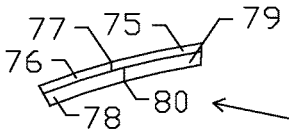
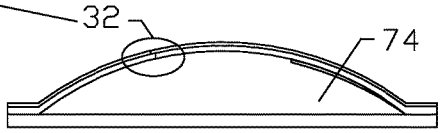
FIG. 10C
FIG. 10F
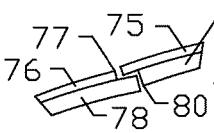
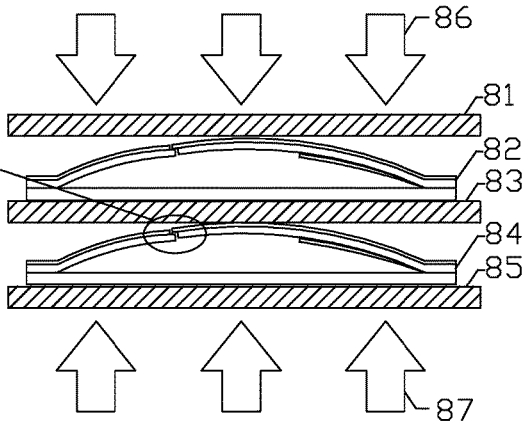
FIG. 10E

MECHANICAL-WAVES DISSIPATING PROTECTIVE HEADGEAR APPARATUS

TECHNICAL FIELD

The present invention relates generally to the field of protecting the human brain upon a trauma. More specifically, the present invention provides an apparatus to reduce an intensity of mechanical waves from the trauma to the human brain.

BACKGROUND OF THE INVENTION

Injurious blunt trauma to a human brain should be understood as delivery of mechanical waves to the human brain which then undergoes intercellular and intracellular changes such as findings associated with diffuse axonal injury and cerebral vasospasm without bleeding from cerebral blood vessels. Changes in electrochemical, molecular and signaling pathways of tissue must occur, including integrin mediated activation of Rho kinase and phenotypic switches indicative of vascular remodeling. As of now, we are at an early stage of our understanding of pathogenesis of the blunt trauma and its consequences.

In the previous patent application (U.S. patent application Ser. No. 15/083,407) for a protective headgear for the human brain, I proposed that boundary effect of mechanical waves of the blunt trauma would be exploited for reducing an amplitude of the mechanical waves delivered to a brain tissue, using a multi-layered protective shell to increase number of boundaries inside the protective shell as practically many as possible to a point there would not be a serious tissue injury to the brain tissue. Of materials transferring energy from the mechanical waves, air (gas) has by far a lowest density of molecules per area, thereby having a lowest index of transfer function as a medium for the mechanical waves. I proposed that the protective shell be configured to be pressurized with a gas and to let the gas released upon an impact from the blunt trauma. If an amplitude of the mechanical waves of a blunt trauma does not exceed a resistive pressure of an impacted gas inside the protective shell, the amplitude of the mechanical waves will go through the layered boundaries in the way described above except that the impacted gas would not be released and some of the mechanical waves will transform to heat and some others transmitted to the brain tissue. If the amplitude of the mechanical waves of the blunt trauma exceeds the resistive pressure of the impacted gas inside the protective shell, then a portion of the impacted gas will be released from the protective shell upon the impact of the blunt trauma. It results in a depletion of a portion of an impact energy carried in the impacted gas, which is a decrease in the amplitude of the mechanical waves reaching the brain tissue. While the number of the layered boundaries of the protective shell is fixed once manufactured, the pressure of the gas in the protective shell can be variably adjustable based on a weight of a person wearing the protective shell and anticipated types and scenarios of an injury. Combining both methods for the protective shell would therefore be more advantageous to using either method alone.

Incident mechanical waves traveling in an ambient air do not undergo phase change upon hitting a medium having a higher impedance to mechanical waves than that of air. Some of the mechanical waves will be reflected off the medium without the phase change, and some will be transmitted through the medium. If the medium has a finite dimension through which the transmitted mechanical waves travel, the transmitted mechanical waves come out from the other side of the medium to the ambient air. The transmitted mechanical waves coming out from the medium to the ambient air then undergo phase reversal, similar to the phase reversal of the mechanical waves reflecting off a lower impedance medium. A part of energy (amplitude) of the mechanical waves is known to be lost during transition from a medium having a higher impedance to a medium having a lower impedance to mechanical waves. If a first layer of a medium of a higher impedance to mechanical waves is adhered in tandem to a second layer of a medium of a lower impedance to mechanical waves forming a two-layered boundary, incident mechanical waves to the first layer will be reflected off an outer surface of the first layer in phase and some of the incident mechanical waves will be transmitted to the second layer out of phase while dissipating energy (reducing amplitude) at a border between the first and second layers. The transmitted mechanical waves through the second layer will come out through an inner surface of the second layer out of phase a second time, which results in mechanical waves in phase with the original incident mechanical waves. It also results in dissipation of the energy of the mechanical waves a second time at a border between the outer surface of the second layer and the ambient air. A part of the transmitted mechanical waves through the second layer will bounce back in phase at the outer surface of the second layer bordering the ambient air, which travels continuously through the first layer without phase change. Upon exit through the outer surface of the first layer, the mechanical waves emerge out of phase. It results in dissipation of the energy of the mechanical waves a third time at a border between the outer surface of the first layer and the ambient air. The aforementioned process of reflections and transmissions of mechanical waves across the two-layered boundary contributes to a loss of the energy (reduction in amplitude) of the mechanical waves from an original state of the energy.

In a closed system which stacks up in parallel multiple two-layered boundaries, the loss of the energy of the mechanical waves through the reflections and transmissions across the two-layered boundary could be maximized if each two-layered boundary is separated from the other two-layered boundary without physical contact between them. The mechanical waves travel through physical contact points between two opposing sets of the two-layered boundary if they maintain a contact with each other when the mechanical waves are delivered. Furthermore, if a first two-layered boundary has an impedance to the mechanical waves different from that of a second two-layered boundary, there will be an additional loss of the energy of the mechanical waves at a time the mechanical waves travel from the first two-layered boundary to the second two-layered boundary if transmission of the mechanical waves from the first to the second two-layered boundaries is synchronized with reversible physical contact between the first and the second two-layered boundaries.

In a pressure zone immediately adjacent to the outer surface of the two-layered boundary facing the incident mechanical waves from a blunt trauma, reflected mechanical waves off the outer surface add to the incident mechanical waves toward the outer surface. As the reflected mechanical waves are in phase with the incident mechanical waves, addition of the reflected mechanical waves to the incident mechanical waves double up an amplitude of the mechanical waves. The doubling-up of the amplitude of the mechanical waves occurs at a region of the outer surface of the two-layered boundary where the incident mechanical waves come in contact with and in the pressure zone immediately adjacent to the outer surface, thereby increasing an energy of an impact of the blunt trauma to the region of the outer surface. Process of the doubling-up of the amplitude of the mechanical waves could be disrupted if a gas in the pressure zone as a medium receiving the doubled-up amplitude of the mechanical waves is taken away from the pressure zone as soon as the doubled-up amplitude of the mechanical waves is delivered to the gas. It can be accomplished by venting the gas from a distended compressible gas cell affixed to the outer surface at a time and a place the reflected mechanical waves add to the incident mechanical waves.

SUMMARY OF THE INVENTION

To improve on efficiency in reduction of an amplitude of mechanical waves of a blunt trauma to a human brain by a headgear having a pressurizable and ventable outer balloon shell and a plurality of independent inner layers disposed inside the pressurizable and ventable outer balloon shell, the present invention comprises a semi-elastic pressurizable and ventable outer balloon shell, a plurality of independent semi-rigid inner layers concentrically stacked up inside the pressurizable and ventable outer balloon shell, an inner hard shell and a plurality of tubular paddings. The pressurizable and ventable outer balloon shell is inflatable and pressurizable by a gas which is quantifiably releasable upon the blunt trauma through gas valves to atmosphere once a threshold for venting is exceeded by the mechanical waves of the blunt trauma. Pressure of the gas inside the pressurizable and ventable outer balloon shell is made variably adjustable and monitored by a pressure sensor device which has an alarm function of both a sound alarm and flashing lights. Each independent inner layer is configured to be separated by a distance from the other independent inner layer, wherein the distance is configured to accommodate a pressure zone between two independent inner layers. The independent inner layer comprises a dome-shaped sheet to which a number of ventable gas cells are attached, arranged in a mosaic pattern. Around a rim of the pressurizable and ventable outer balloon shell, there is provided an enlarged ballooned chamber which each inner layer ends up with a ruffled free-ended margin in and which securely anchors the independent inner layers to an inner surface of the chamber. The two-layered tubular paddings are provided in between the inner hard shell and a human head.

In one embodiment, the pressurizable and ventable outer balloon shell comprises a dome configured in a substantially hemispherical bowl shape and a ballooned rim adjoining a lower circumferential margin of the dome. The pressurizable outer balloon shell is an airtight inflatable shell, and has a pressurized-gas intake valve located on a lower surface of a posterior ballooned rim and a group of pressure-triggerable gas release valves located on the lower surface of the ballooned rim along a circumference of the ballooned rim. On a side of an outer surface of the ballooned rim, the pressure sensor device having the alarm function of the sound alarm and flashing lights is installed, which measures an internal pressure of the pressurizable outer balloon shell. The dome and the adjoining ballooned rim are configured to tightly adhere to the inner hard shell. Both the pressurizable outer balloon shell and the inner hard shell are configured to cover an area of the human head comprising a part of frontal, an entire parietal, a majority of temporal and an entire occipital region. The pressurizable and ventable outer balloon shell is made of a combination of thermoplastic elastomers having a higher proportion of soft component such as polybutadiene, polyisobutylene or polysiloxane, which results in a lower Shore scale compared to thermoplastic elastomers having a higher proportion of hard component such as polyurethane, ethylene propylene diene or fluropolymers. Styrene-butadiene-styrene block copolymer could also be used for the pressurizable and ventable outer balloon shell. The combination of the thermoplastic elastomers is made to withstand a range of internal pressure of the pressurizable outer balloon shell above atmospheric pressure over a range of temperature from 0° F. to 175° F. and a blunt impact without material failure.

In one embodiment, an outer surface of the pressurizable and ventable outer balloon shell is configured to be adherently covered by a thin semi-rigid thermoplastic elastomeric layer which has a higher Shore scale than the thermoplastic elastomer of the pressurizable and ventable outer balloon shell. The thin semi-rigid thermoplastic elastomeric layer is made with a higher proportion of hard component such as polyurethane, ethylene propylene diene monomer or fluropolymers so as to impart a hardness enough to withstand a blunt trauma without material failure and to protect the thermoplastic elastomer of the pressurizable and ventable outer balloon shell.

In one embodiment, the pressurized-gas intake valve is in a configuration of Schrader-type valve for pressurized gas embedded inside the lower surface of the posterior ballooned rim with an opening of the pressurized-gas intake valve disposed on the lower surface, without protruding parts beyond the lower surface. In one embodiment, the pressure-triggerable gas release valves are configured in a spring-operated pressure release valve which is a quick release valve. The spring is configured as compression spring which provides resistance to a range of axial compressive pressure up to a predetermined set pressure limit beyond which the spring yields to the axial compressive pressure. The pressure-triggerable gas release valves are embedded inside the lower surface of the circumference of the ballooned rim in a way at least one gas vent is assigned to each anatomic region of the head, which is to facilitate release of the impacted gas from the impacted region of the head to a nearest pressure-triggerable gas release valve without dissemination of the impacted gas around an internal space of the protective outer shell. It is to reduce rippling surface waves traveling across the protective outer shell, thereby reducing resonant amplification of the amplitude of the mechanical waves.

In one embodiment, the dome and the ballooned rim of the pressurizable and ventable outer balloon shell is configured to provide an airtight, inflatable and pressurizable space which encloses a plurality of the independent inner layers in a dome configuration concentrically stacked up. Both an outer wall and an inner wall of the dome, made of the semi-elastic thermoplastic elastomer, are configured to be reversibly and depressibly deformable at an angle to a planar surface of the wall upon an impact of the blunt trauma. The outer and inner wall of the dome are not physically attached to the independent inner layers, but form a closed enclosure to enclose the independent inner layers inside the pressurizable and ventable outer balloon shell. The Shore scale hardness of the outer and inner wall of the dome is configured to be lower than that of the independent inner layer so as to let the outer and inner wall of the dome be more deformable than the independent inner layer upon an impact of a blunt trauma to the pressurizable and ventable outer balloon shell.

In one embodiment, the pressurizable and ventable outer balloon shell is configured with a plurality of fenestrations, wherein a fenestration comprises a fenestrating hole on the outer wall and the inner wall of the pressurizable and ventable balloon outer shell, respectively, and both fenestrating holes are connected by a fenestrating tubular wall which runs through the dome of the pressurizable and ventable outer balloon shell along a radial line of the dome toward an axial center of the dome. The fenestrations are configured to ventilate the headgear having the pressurizable and ventable outer balloon shell.

In one embodiment, the independent inner layer is configured as an at least two-layered sheet having a first layer made of a first thermoplastic elastomer and a second layer made of a second thermoplastic elastomer, wherein an impedance of the first thermoplastic elastomer of the first layer to mechanical waves is configured to be higher than that of the second thermoplastic elastomer of the second layer. An example of the first thermoplastic elastomer is thermoplastic polyolefin elastomers and an example of the second thermoplastic elastomer is thermoplastic polyurethane elastomers. The first and the second layers are compressed together under heat to meld the thermoplastic elastomers to impart semi-rigid hardness with reversible deformability over a range of temperature and enough tear strength to withstand repetitive deformative impacts from the blunt trauma without material failure. The independent inner layer is configured to have a higher Shore scale on hardness than that of the pressurizable and ventable outer balloon shell. The at least two-layered independent inner layer is configured to reduce an amplitude of incident and transmitted mechanical waves at a border between the first and the second layers based on a difference in the impedance of thermoplastic elastomers to the mechanical waves.

In one embodiment, the at least two-layered independent inner layer is polarized in terms of a level of the impedance of each layer to mechanical waves. There are two opposite directions of mechanical waves to the independent inner layer at a time of an impact of the blunt trauma, with a first direction from a region of the pressurizable and ventable outer balloon shell of the impact of the blunt trauma to the human head of a recipient and a second direction from the human head of the recipient to the region of the impact of the blunt trauma. A group of outer independent inner layers disposed closer to the outer wall of the pressurizable and ventable outer balloon shell receiving the mechanical waves from the blunt trauma toward the human head are configured to have the first layer of the first thermoplastic elastomer having the higher impedance to the mechanical waves on an outer part of said outer independent inner layers facing toward the incoming blunt trauma and the second layer of the second thermoplastic elastomer having the lower impedance on an inner part of said independent inner layers facing away from the incoming blunt trauma. A group of inner independent inner layers disposed closer to the inner wall of the pressurizable and ventable outer balloon shell receiving the mechanical waves from the human head of the recipient toward the region of the impact of the blunt trauma are configured to have the first layer of the first thermoplastic elastomer having the higher impedance on an inner part of said inner independent inner layers facing toward the human head of the recipient and the second layer of the second thermoplastic elastomer having the lower impedance on an outer part of said independent inner layers facing away from the human head of the recipient. In a mid point between the outer independent inner layers disposed close to the outer wall and the inner independent inner layers close to the inner wall of the pressurizable and ventable outer balloon shell, there is provided an independent inner layer having at least three layers of thermoplastic elastomers. The three-layered mid-point independent inner layer comprises two outer layers comprising a thermoplastic elastomer having a higher impedance to the mechanical waves similar to that of the first thermoplastic elastomer of the first layer of the independent inner layer disposed closer to the outer and inner walls, and a mid layer comprising a thermoplastic elastomer having a lower impedance similar to that of the second thermoplastic elastomer of the second layer of the independent inner layer disposed close to the outer and inner walls.

In one embodiment, a circumferential margin of the independent inner layer is made corrugated and slit a number of times at a right angle to the margin for a distance to produce a plurality of strips in ruffled configuration. The ruffled free-ended circumferential margin of the independent inner layer is packed in the ballooned rim. A pair of circumferential ridges are provided above the ruffled free-ended circumferential margin of the independent inner layer, with one circumferential ridge on an outer surface and the other circumferential ridge on an inner surface of the independent inner layer. A circumferential ridge disposed on a surface of an independent inner layer closest to an inner surface of the ballooned rim is configured to be anchored to the ballooned rim by a corresponding circumferential ridge disposed on the inner surface of the ballooned rim. A circumferential ridge disposed on a surface of an independent inner layer located adjacent to the other independent inner layer is configured to be anchored to a corresponding circumferential ridge of the other independent inner layer. A vertical height of the circumferential ridge of an independent inner layer is configured to be higher than a maximum vertical height of a ventable gas cell attached to the independent inner layer, so as to provide a non-contact space between two opposing independent inner layers. The no-contact space is configured to accommodate the pressure zone between two opposing independent inner layers generated by a doubling-up process of incident mechanical waves of the blunt trauma hitting the independent inner layer with reflected in-phase mechanical waves from the independent inner layer.

In one embodiment, a plurality of ventable gas cells are fixedly attached to a surface of the independent inner layer, with each ventable gas cell separated from the other ventable gas cell by a distance and arranged in the mosaic pattern. In a space between each ventable gas cell, the independent inner layer is fenestrated corresponding to a fenestrating tubular wall of the pressurizable and ventable outer balloon shell. Attachment of the ventable gas cells follows polarity of the independent inner layer, wherein the ventable gas cells are attached to an outer surface of the first layer of the independent inner layer having the first thermoplastic elastomer with the higher impedance to the mechanical waves. For the independent inner layer at the mid point between the outer wall and the inner wall of the pressurizable and ventable outer balloon shell, ventable gas cells are attached to both sides of said independent inner layer.

In one embodiment, the ventable gas cell is configured in a relatively broad base fixedly glued to a semi-elliptical top of a relatively short vertical height fixedly attached to the broad base to form a relatively flat semi-elliptical dome. The broad base is fixedly attached to the surface of the independent inner layer and the semi-elliptical dome protrudes in a direction away from the surface of the independent inner layer. The ventable gas cell is made of a plurality of thermoplastic elastomers which impart bulging distensibility and compressible deformability to the semi-elliptical dome. The semi-elliptical dome is a two-ply sheet, having an outer ply bonded with an inner ply under heat to form an inseparable sheet. The outer ply is made of one thermoplastic elastomer and has a higher hardness on the Shore scale than the inner ply made of a different thermoplastic elastomer. The semi-elliptical dome comprises a gas vent slit of a length along a longitudinal axis of the semi-elliptical dome, which is configured to vent the gas out upon compression of the semi-elliptical dome. The slit is a two-ply structure, having an outer slit made on the outer ply and an inner slit made on the inner ply. The outer slit is offset with the inner slit on the longitudinal axis of the semi-elliptical dome, with the outer slit separated by a distance from the inner slit in a way that the outer ply covers the inner slit for the offset distance between the outer slit and the inner slit. The offset configuration of the two slits is to let the semi-elliptical dome distended by a pressurized gas which cannot escape through the inner slit from the semi-elliptical dome unless both the outer and inner slits are open. The semi-elliptical dome is compressible into two halves having each half on one side of the outer slit by compression on the semi-elliptical dome. If the compression of the semi-elliptical dome is deep enough toward the broad base, both the outer slit and inner slit are open and let the pressurized gas vented out from the ventable gas cell. On one side of the semi-elliptical dome, there is provided a gas intake opening with an one-way valve underneath the inner ply of the semi-elliptical dome through which a gas moves into the ventable gas cell upon pressure. When the gas is pumped into the pressurizable outer balloon shell through the Schrader-type valve located in the lower surface of the posterior ballooned rim, it distends the pressurizable and ventable outer balloon shell and at the same time distends the ventable gas cells through the gas intake opening of the semi-elliptical dome of the ventable gas cells of the independent inner layer.

In one embodiment, the pressurizable and ventable outer balloon shell is configured to dissipate the mechanical waves of the impact of the blunt trauma to the pressurizable and ventable outer balloon shell by the independent inner layers based on the difference in the impedance of thermoplastic elastomers of the independent inner layers and by venting the gas from the pressurizable and ventable outer balloon shell to the atmosphere. In particular, the venting of the gas is configured to start from compression of ventable gas cells of the independent inner layers located at and around an impact region of the blunt trauma, wherein the venting of the gas is configured to discharge a gas containing a doubled-up amplitude of the mechanical waves in a pressure zone inside the pressurizable and ventable outer balloon shell to the atmosphere.

In one embodiment, the pressurizable and ventable outer balloon shell is configured to dissipate the mechanical waves of the impact of the blunt trauma to the pressurizable and ventable outer balloon shell in sequence through a series of pressure zones produced by the independent inner layers inside the pressurizable and ventable outer balloon shell. When there is an impact of a blunt trauma to a head wearing the mechanical waves dispersing protective headgear apparatus, there come two opposing mechanical waves to the pressurizable and ventable outer balloon shell, with a first group of mechanical waves from the blunt trauma to the pressurizable and ventable outer balloon shell and a second group of mechanical waves from the head to the pressurizable and ventable outer balloon shell. Within the pressurizable and ventable outer balloon shell which by itself serves as a large pressure zone for the mechanical waves, these two opposing mechanical waves collide in phase and double up their amplitudes. Placement of the independent inner layers having ventable gas cells inside the pressurizable and ventable outer balloon shell is configured to split the large pressure zone into a group of small pressure zones. Efficiency in dissipation of the mechanical waves goes up if the amplitude of the mechanical waves is reduced in sequence, i.e., one pressure zone after another, compared to an attempt to dissipate the amplitude of the mechanical waves simultaneously from all small pressure zones inside the pressurizable and ventable outer balloon shell. In a split pressure zone system comprising a plurality of the small pressure zones, if a first pressure zone does not dissipate the amplitude of the mechanical waves completely, remaining amplitudes of the mechanical waves are dissipated from a second and subsequent pressure zones. To achieve this configuration, a first independent inner layer closest to the outer wall of the pressurizable and ventable outer balloon shell is configured to have a lower overall Shore scale hardness than a second independent inner layer disposed under the first independent inner layer, and the second independent inner layer has a lower overall Shore scale hardness than a third independent inner layer disposed under the second independent inner layer and so on until it comes to the independent inner layer at the mid point between the outer wall and the inner wall of the pressurizable and ventable outer balloon shell. The independent inner layer at the mid point between the outer wall and the inner wall of the pressurizable and ventable outer balloon shell is configured to have the highest overall Shore scale hardness. A first independent inner layer under and closest to the independent inner layer at the mid point is configured to have a lower overall Shore scale hardness than the independent inner layer at the mid point. A second independent inner layer disposed under the first independent inner layer under and closest to the independent inner layer at the mid point is configured to have a lower overall Shore scale hardness than the first independent inner layer under and closest to the independent inner layer at the mid point, and so on.

In one embodiment, a gas pressure in the pressurizable and ventable outer balloon shell is monitored by a piezoresistive pressure sensor device which is a sealed pressure sensor type and battery-operated. It is configured to measure a range of operational pressure of the gas inside the pressurizable and ventable outer balloon shell and to generate both the sound alarm and flashing lights. A pressure sensor circuit board with a battery of the pressure sensor device is affixed to the inner wall of the ballooned rim and an alarm part of the pressure sensor device protrudes through the wall of the ballooned rim to an outer surface of the ballooned rim for a piezoelectric speaker generating the sound alarm and a visual display for flashing lights. The visual display part comprises color-coded light emitting diodes which flash a certain type of color such as blue if the gas pressure inside the pressurizable and ventable outer balloon shell is above or red if below a certain threshold of the gas pressure that the pressurizable and ventable outer balloon shell is set to maintain for proper operational protection of a head of a user.

In one embodiment, the inner hard shell is provided in a dome configuration, and comprises at least two layers with an outer layer made of an impact resistant polymer such as carbon-fiber-reinforced-polymer or glass-fiber reinforced nylon and an inner layer made of thermoplastic elastomers having a lower Shore scale hardness than that of the outer layer. The inner hard shell is configured to protect the skull against fracture upon the impact of the blunt trauma to the head. The inner hard shell is fenestrated with a plurality of fenestrations to provide ventilation, wherein each fenestration corresponds to a fenestration of the inner wall of the pressurizable and ventable outer balloon shell.

In one embodiment, a plurality of tubular paddings are provided in a hexagonal configuration along a longitudinal axis of said tubular padding, wherein each tubular padding comprises an outer layer made of a first thermoplastic elastomer having a lower Shore scale hardness than an inner layer made of a second thermoplastic elastomer. The outer and inner layers are made of a combination of thermoplastic elastomers having a higher proportion of soft component such as polybutadiene, polyisobutylene or polysiloxane, or styrene-butadiene-styrene block copolymer. The tubular padding is configured to be compressible on a longitudinal side wall, and both longitudinal ends of the tubular padding is open. Similar to the pressure zone inside the pressurizable and ventable outer balloon shell, a space between the head of the recipient of the blunt trauma and the inner layer of the inner hard shell produces a pressure zone made of doubling-up of amplitudes of incident mechanical waves and reflected mechanical waves off the head of the recipient unless the inner layer of the inner hard shell tightly attaches to the head without an intervening space. The tubular padding is configured to push out an air from the space between the head of the recipient of the blunt trauma and the inner layer of the inner hard shell at a time of the impact of the blunt trauma to the head to reduce the doubling-up of amplitudes of the mechanical waves and to ventilate the space.

In one embodiment, the fenestrations of the mechanical waves dissipating protective headgear apparatus are configured to be open to the atmosphere for the doubled-up mechanical waves generated inside the space between the head of the recipient of the blunt trauma and the inner layer of the inner hard shell and to ventilate said space. In a closed system of an inner hard shell without the fenestrations, incident mechanical waves from the head of the recipient toward an inner layer of the inner hard shell without the fenestrations will be reflected off the inner layer of the inner hard shell without the fenestrations back to the head of the recipient. The reflected mechanical waves hitting the head of the recipient again will be reflected off toward the inner layer of the inner hard shell without the fenestrations. This process will continue in a way there will be not only a process of doubling-up of the mechanical waves but also resonance of the mechanical waves which will be transmitted across the head to other regions of the head. This process would be minimized if the air carrying the mechanical waves in the space is communicated with the ambient air outside the mechanical waves dissipating protective headgear apparatus and pushed out by the tubular paddings upon compression of said tubular paddings.

BRIEF DESCRIPTION OF THE DRAWINGS

FIG. 2A represents a schematic view of a hard outer shell cover; FIG. 2B shows a schematic view of a pressurizable and ventable outer balloon shell; FIG. 2C shows a schematic view of an inner hard shell; FIG. 2D shows a schematic view of a plurality of tubular paddings.

Referring to FIG. 2B.

FIG. 10A shows a schematic three-dimensional view of the ventable gas cell; FIG. 10B shows a schematic profile outline view of the ventable gas cell; FIG. 10C shows an offset vent slit in a closed configuration; FIG. 10D shows a magnified schematic profile outline view of the offset vent slit in the closed configuration; FIG. 10E shows a schematic profile outline view of the offset slit in an open configuration upon an impact; FIG. 10F shows a magnified schematic profile outline view of the offset slit in the open configuration upon the impact.

DETAILED DESCRIPTION OF THE DRAWINGS

As described below, the present invention provides a mechanical-waves dissipating protective headgear apparatus. It is to be understood that the descriptions are solely for the purposes of illustrating the present invention, and should not be understood in any way as restrictive or limited. Embodiments of the present invention are preferably depicted with reference to FIGS. 1 to 13, however, such reference is not intended to limit the present invention in any manner. The drawings do not represent actual dimension of devices, but illustrate the principles of the present invention.

Figure 1:
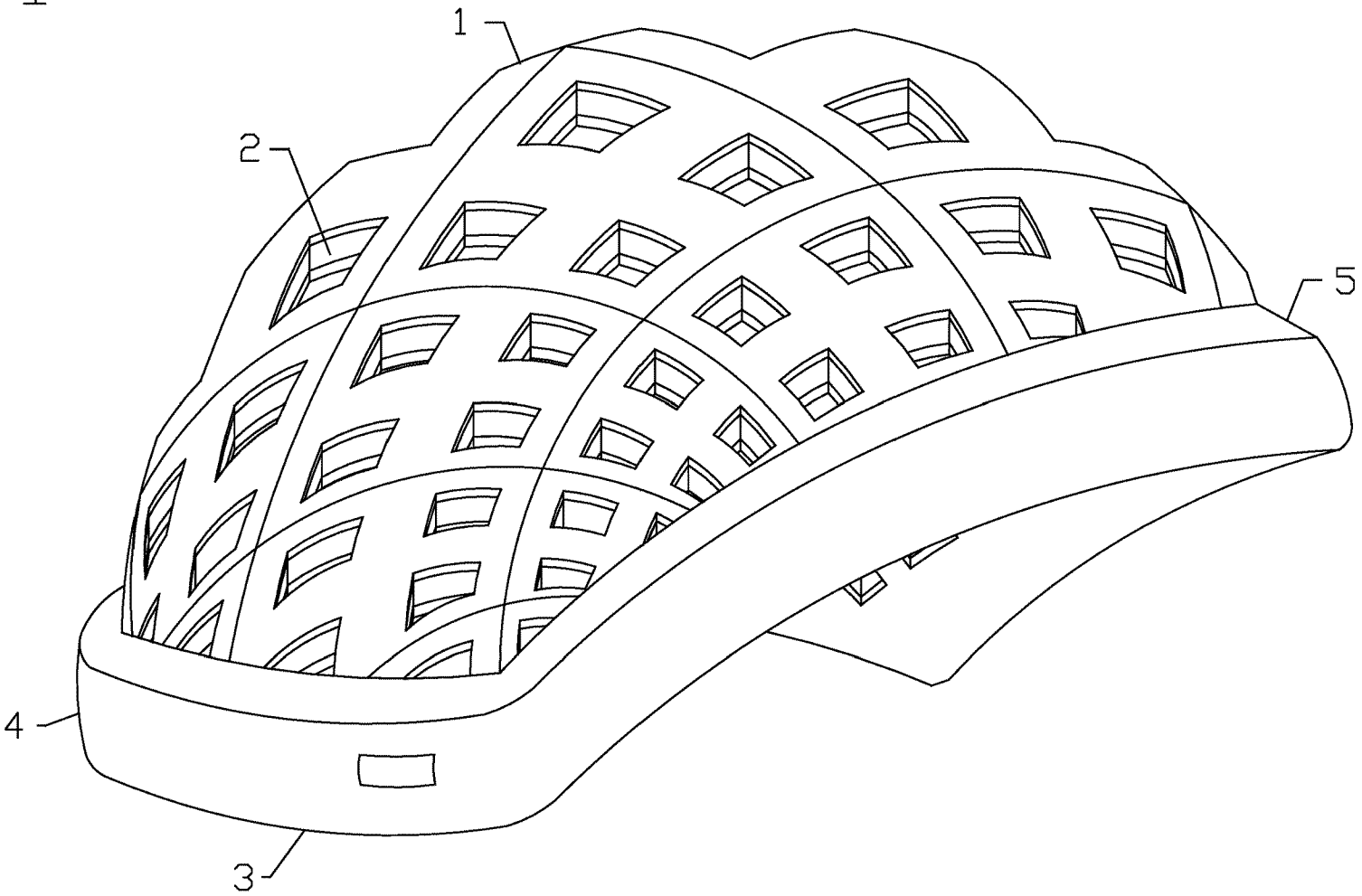
FIG. 1 shows a schematic presentation of a mechanical waves dissipating protective headgear apparatus.

FIG. 1 shows a schematic presentation of a mechanical waves dissipating protective headgear apparatus which comprises a dome portion 1 covering the majority of a head including frontal, parietal, sphenoid, occipital and temporal regions, a plurality of fenestrations 2 for ventilation of said mechanical waves dissipating protective headgear apparatus, a lower ballooned rim 3 covering a portion of the zygomatic arch and the mastoid protuberance, an occipital portion 4 of the ballooned rim covering the occipital region to below the external occipital protuberance and a frontal portion 5 of the ballooned rim covering down to a part of the vertical portion of the frontal region of the head.

Figure 2A:
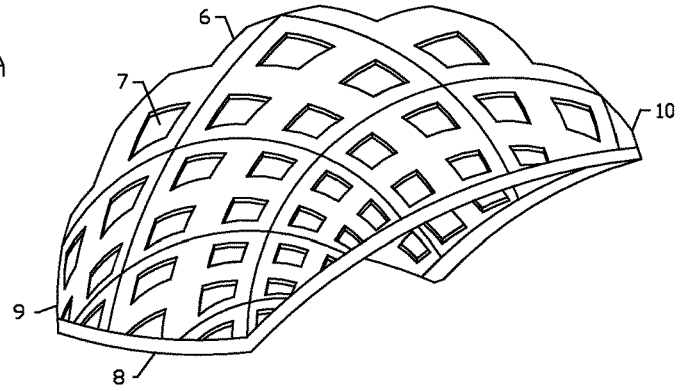
FIGS. 2A-2D show individual components of the mechanical waves dissipating protective headgear apparatus.
Figure 2B:
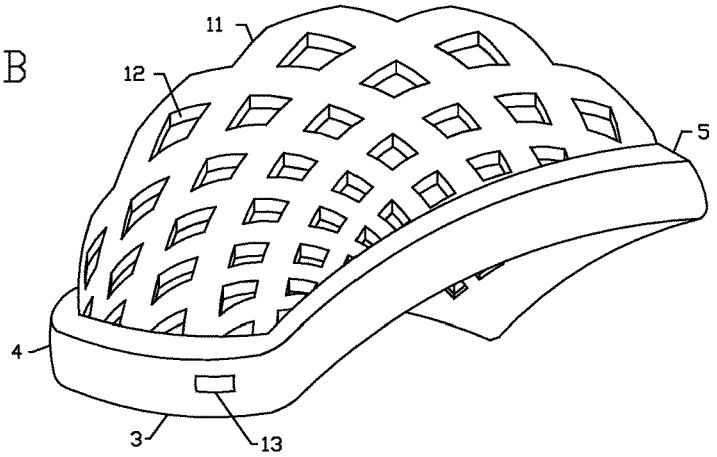
Figure 2C:
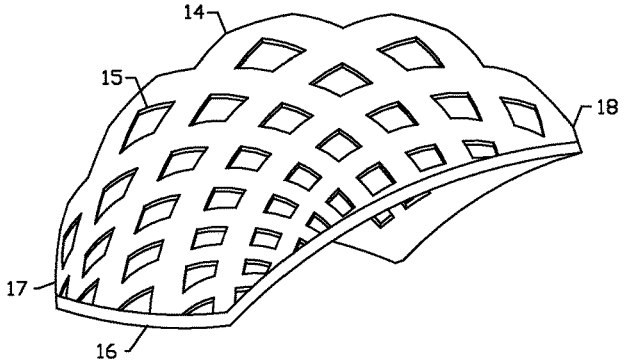
Figure 2D:
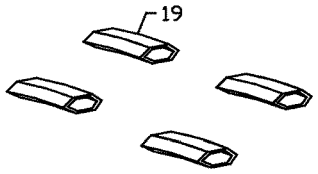

FIGS. 2A-2D show a schematic view of components of the mechanical waves dissipating protective headgear apparatus shown in FIG. 1. FIG. 2A represents a schematic view of a hard outer shell cover which is configured to tightly attach to an upper surface of a pressurizable and ventable outer balloon shell of FIG. 2B. The outer hard shell in FIG. 2A comprises a dome portion 6, a plurality of fenestrations 7 configured to be aligned with fenestrations 12 of the pressurizable and ventable outer balloon shell of FIG. 2B, an attachment rim 8 which is configured to adherently fasten the hard outer shell cover to an outer circumferential rim margin of a dome portion 11 of the pressurizable and ventable outer balloon shell of FIG. 2B, an occipital portion 9 and a frontal portion 10. FIG. 2B shows a schematic view of the pressurizable and ventable outer balloon shell which comprises the dome portion 11, a plurality of fenestrations 12, the lower ballooned rim 3, the occipital portion 4 and the frontal portion 5 of the ballooned rim, and a pressure sensor device 13 disposed on a surface of the lower ballooned rim 3. FIG. 2C shows a schematic view of an inner hard shell which comprises a dome portion 14, a plurality of fenestrations 15, an attachment rim 16 which is configured to adherently fasten the inner hard shell to an inner circumferential rim margin of the dome portion 11 of the pressurizable and ventable outer balloon shell of FIG. 2B, an occipital portion 17 and a frontal portion 18. FIG. 2D shows a schematic view of a plurality of tubular paddings 19 which is provided in a hexagonal configuration along a longitudinal axis and is configured to be disposed between an inner surface of the inner hard shell of FIG. 2C and the head.

Figures 3A, 3B, 3C:
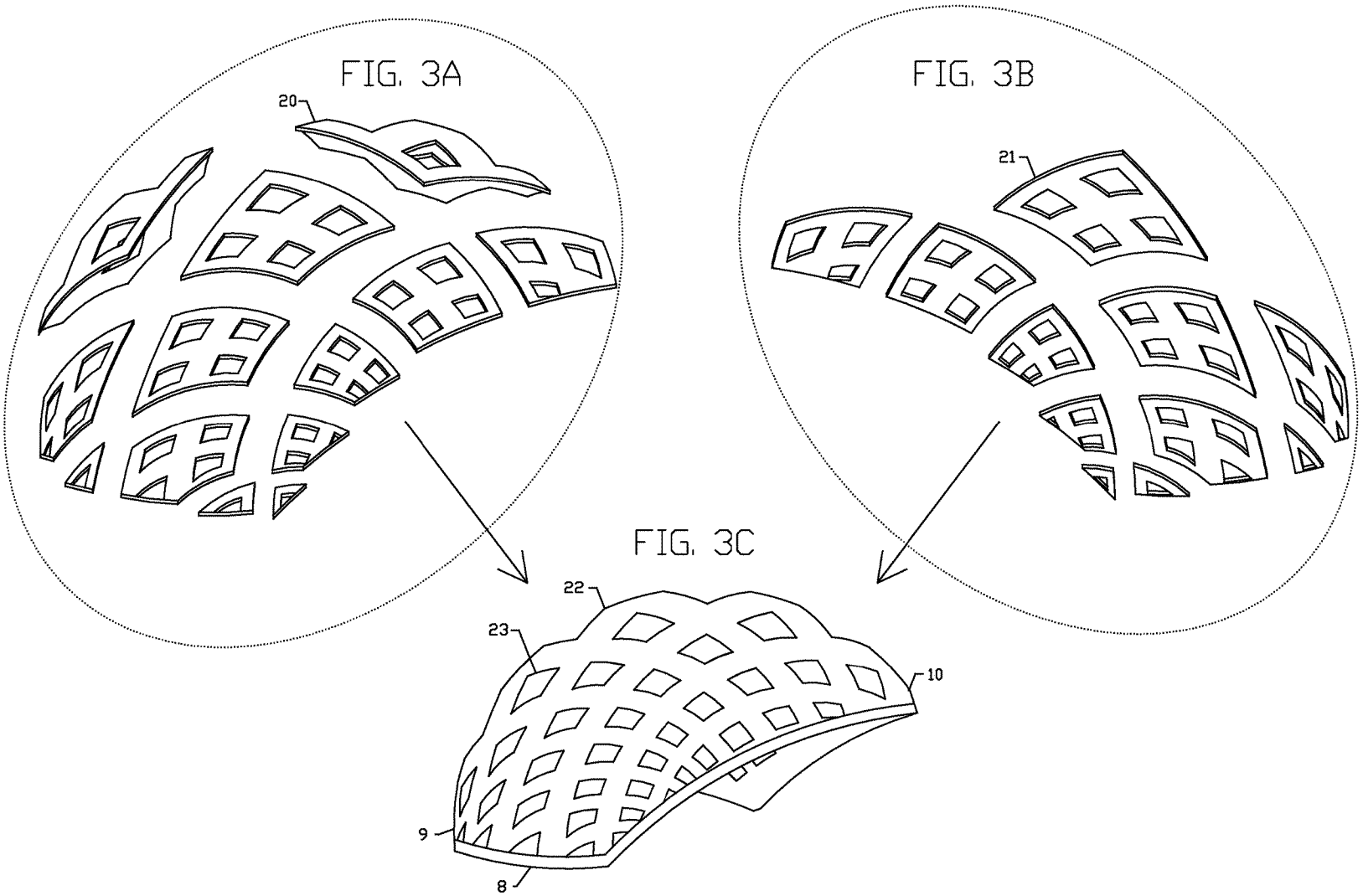
FIGS. 3A and 3B illustrate a schematic view of individual tiles of the hard shell cover.
FIG. 3C represents a schematic view of a base of the hard shell cover to which the individual tiles of the hard shell cover are attached.

FIGS. 3A and 3B illustrate a schematic view of individual tiles represented by 20 and 21 of the hard shell cover, which is made of a thin semi-rigid thermoplastic elastomeric layer having a higher Shore scale than a thermoplastic elastomer of the pressurizable and ventable outer balloon shell. The thin semi-rigid thermoplastic elastomeric layer is made with a higher proportion of hard component such as polyurethane, ethylene propylene diene monomer, fluropolymers or polyolefins, which is to provide the hard shell cover with impact resistance without material failure. The individual tiles represented by 20 and 21 are adhered tightly to a base of the hard shell cover of FIG. 3C. FIG. 3C represents a schematic view of the base of the hard shell cover which comprises a dome portion 22, a plurality of fenestrations 23, the attachment rim 8, the occipital portion 9 and the frontal portion 10. The base is made of a thin sheet of a flexible thermoplastic elastomer. The hard shell cover is provided in a tile configuration, shown in FIG. 2A as an example, to accommodate regional depressive deformation of the pressurizable and ventable outer balloon shell of FIG. 2B upon an impact of a blunt trauma to the pressurizable and ventable outer balloon shell.

Figure 4A:
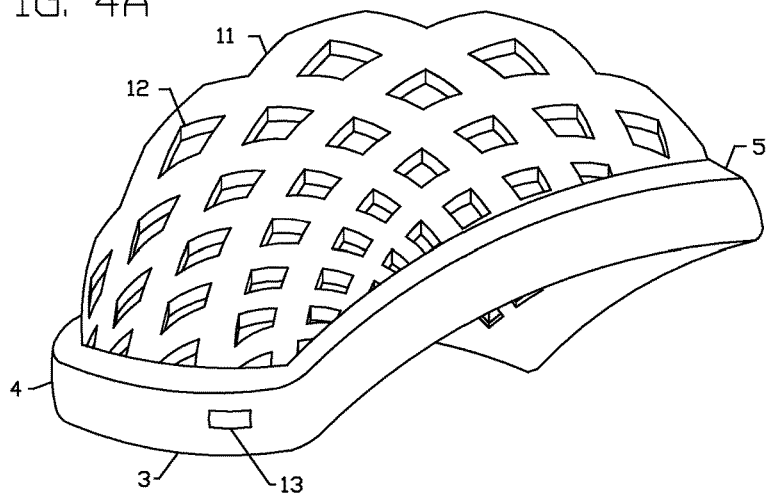
FIG. 4A depicts a schematic view of the pressurizable and ventable outer balloon shell.
Figure 4B:
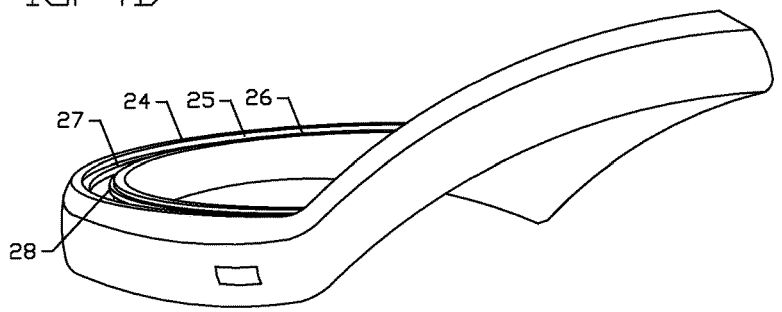
FIG. 4B shows a schematic exposed view of a cutaway portion of a ballooned rim.
Figure 4C:
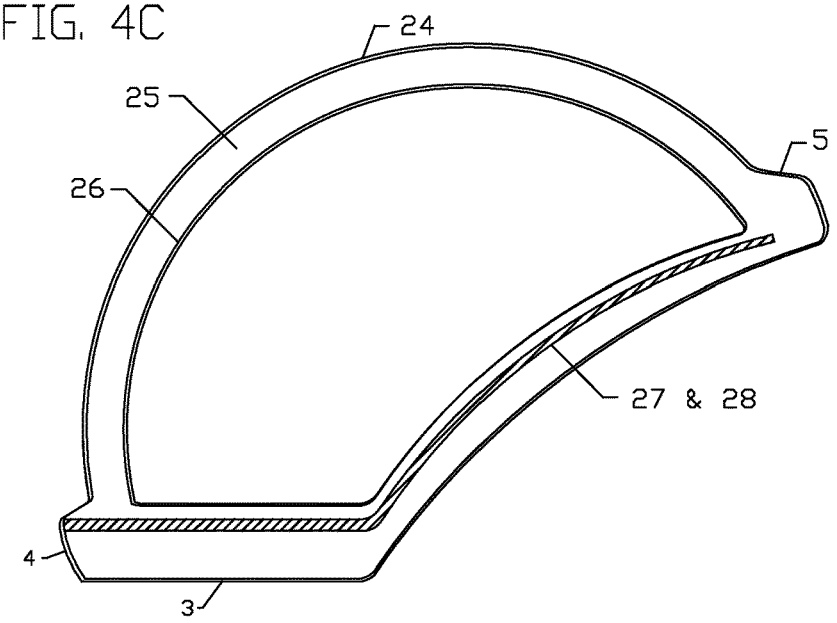
FIG. 4C shows a schematic profile view of the pressurizable and ventable outer balloon shell.

Referring to FIG. 2B, FIG. 4A depicts a schematic view of the pressurizable and ventable outer balloon shell which comprises the dome portion 11, a plurality of fenestrations 12, the lower ballooned rim 3, the occipital portion 4 and the frontal portion 5 of the ballooned rim, and a pressure sensor device 13 disposed on a surface of the lower ballooned rim 3. The dome portion 11 and the ballooned rim 3 are configured to provide an airtight, inflatable and pressurizable space which encloses a plurality of independent inner layers in a dome configuration concentrically stacked up. An outer wall and an inner wall of the dome portion 11 are made of a semi-elastic thermoplastic elastomer having a higher proportion of the soft component, and are configured to be reversibly and depressibly deformable at an angle to a planar surface of the wall upon the impact of the blunt trauma. Referring to FIG. 2B, FIG. 4B shows a schematic exposed view of a cutaway portion of a ballooned rim having an internal space 25 bordered by an outer wall 24 and inner wall 26. On an inner surface of the outer wall 24, there is provided a circumferential ridge 27. Similarly, on an inner surface of the inner wall 26, there is provided a second circumferential ridge 28. Both ridges 27 and 28 are configured to anchor corresponding ridges of independent inner layers to the ballooned rim having the internal space 25. The outer wall 24 of the ballooned rim having the internal space 25 is covered by a thin outer hard shell similar to the hard shell cover shown in FIGS. 2A and 2B, to provide the ballooned rim with the impact resistance without material failure. FIG. 4C shows a schematic profile view of the pressurizable and ventable outer balloon shell comprising the outer wall 24, the inner wall 26, the internal space 25, the circumferential ridges 27 and 28, the lower balloon rim 3, the occipital portion 4 and the frontal portion 5.

Figure 5A:
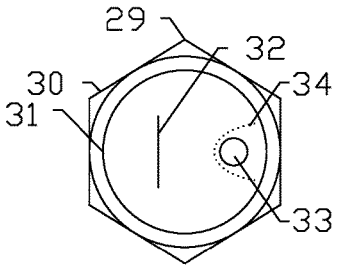
FIG. 5A shows a schematic illustration of a top-down view of a ventable gas cell.
Figure 5B:
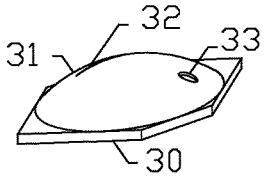
FIG. 5B shows a schematic three-dimensional view of the ventable gas cell.
Figure 5C:
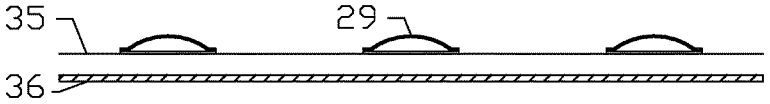
FIG. 5C shows a schematic profile view of a two-layer configuration of an independent inner layer.
Figure 5D:
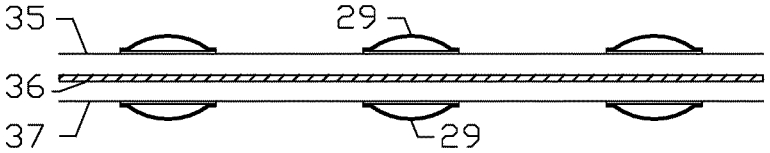
FIG. 5D shows a schematic profile view of a three-layer configuration of an independent inner layer.
Figure 5E:
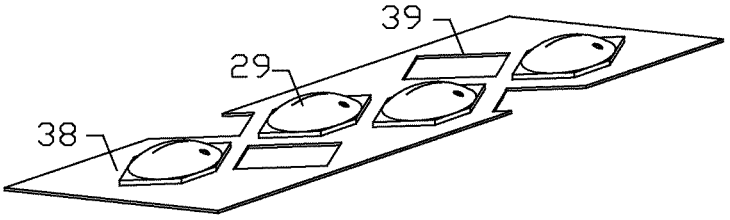
FIG. 5E shows a schematic three-dimensional view of the independent inner layer with ventable gas cells.

FIGS. 5A and 5B show schematic illustrations of a ventable gas cell 29 which comprises a broad base 30 and a semi-elliptical dome 31 which is fixedly glued to the broad base 30. There is provided a gas vent slit 32 along a longitudinal axis of the semi-elliptical dome 31 and a gas intake opening 33 on one side of the semi-elliptical dome 31. The gas intake opening 33 is closed and opened by an one-way valve 34 which is disposed on an undersurface of the semi-elliptical dome 31. FIG. 5C shows a schematic profile view of a two-layer configuration of an independent inner layer which comprises a first layer 35 made of a first thermoplastic elastomer and a second layer 36 made of a second thermoplastic elastomer. An impedance of the first thermoplastic elastomer of the first layer 35 to mechanical waves is configured to be higher than that of the second thermoplastic elastomer of the second layer 36. The first and the second layers 35 and 36 are compressed together under heat to meld the thermoplastic elastomers to impart semi-rigid hardness with reversible deformability over a range of temperature and enough tear strength to withstand repetitive deformative impacts from the blunt trauma without material failure. A plurality of ventable gas cells represented by 29 are fixedly attached to the first layer 35. FIG. 5D shows a schematic profile view of a three-layer configuration of an independent inner layer comprising the first layer 35, the second layer 36 and a third layer 37. A thermoplastic elastomer for the third layer 37 is similar to that of the first layer 35. The outer layer 35 and 37 comprises a thermoplastic elastomer having a higher impedance to the mechanical waves similar to that of the outer layer 35. The second layer 36 comprises a thermoplastic elastomer having a lower impedance than that of the outer layers 35 and 37, which is configured to reduce amplitudes of the mechanical waves crossing the independent inner layer in the three-layered configuration in two opposite directions. FIG. 5E shows a schematic three-dimensional view of the independent inner layer 38 with ventable gas cells 29 and fenestrations represented by 39. The independent inner layer 38 is configured to have a higher Shore scale on hardness than that of the pressurizable and ventable outer balloon shell shown in FIG. 4A.

Figure 6A:
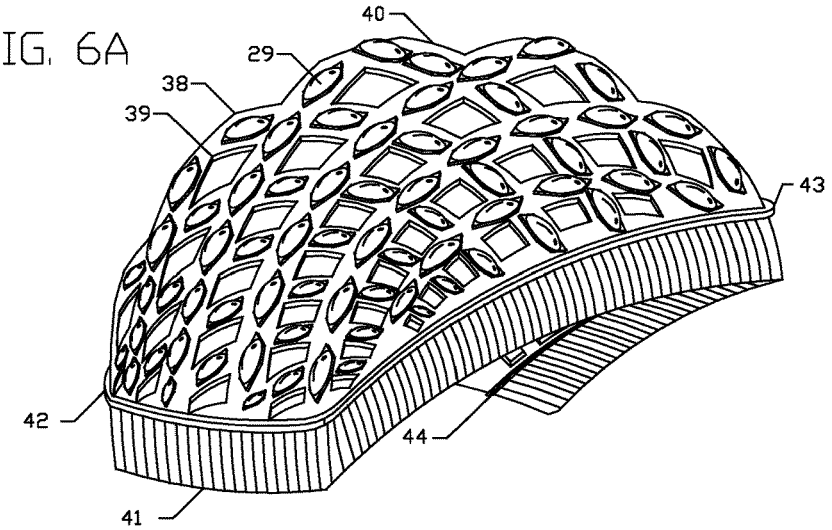
FIG. 6A shows a schematic view of an independent inner layer close to an outer wall of the pressurizable and ventable outer balloon shell.
Figure 6B:
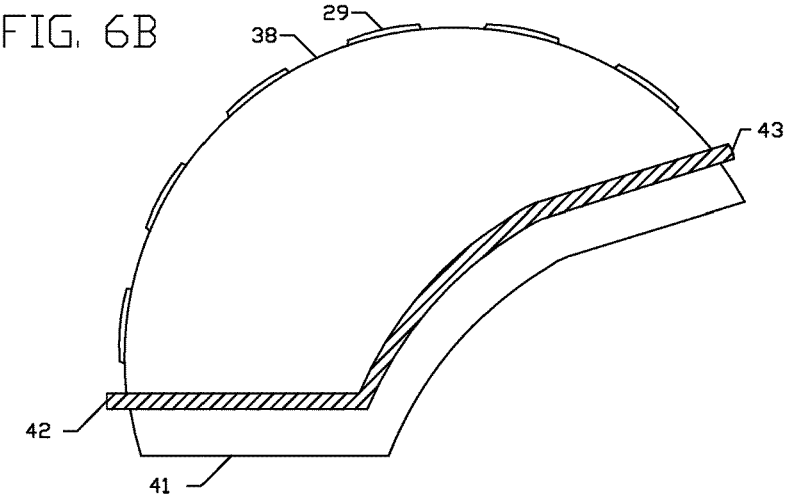
FIG. 6B shows a schematic profile view of the independent inner layer.
Figure 6C:
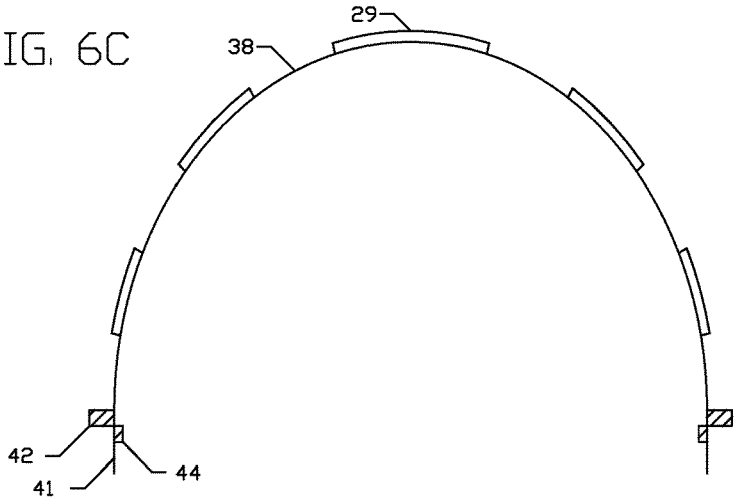
FIG. 6C shows a schematic coronal view of the independent inner layer.

FIGS. 6A-6C show schematic views of the independent inner layer 38 close to the outer wall 24 of the pressurizable and ventable outer balloon shell shown in FIG. 4C, provided in a configuration with ventable gas cells 29 attached on an outer surface of said independent inner layer 38, which comprises a plurality of fenestrations 39, a dome portion 40, a ruffled free-ended circumferential margin 41, an occipital portion of an outer circumferential ridge 42, a frontal portion of the outer circumferential ridge 43 and an inner circumferential ridge 44. The outer circumferential ridge 42-43 is provided above the ruffled free-ended circumferential margin 41, which is configured to be anchored to the ballooned rim by the corresponding circumferential ridge 27 disposed on the inner surface of the ballooned rim having the internal space 25 shown in FIG. 4B. The inner circumferential ridge 44 is provided above the ruffled free-ended circumferential margin 41, which is configured to be anchored by a corresponding circumferential ridge of an adjacent independent inner layer underlying the independent inner layer 38. Shown in FIGS. 6B and 6C, a vertical height of the circumferential ridge 42 of the independent inner layer 38 is configured to be higher than a vertical height of the ventable gas cell 29 attached to the independent inner layer 38, so as to provide a non-contact space between the inner surface of the outer wall 24 of the pressurizable and ventable outer balloon shell shown in FIG. 4C and the independent inner layer 38.

Figure 7A:
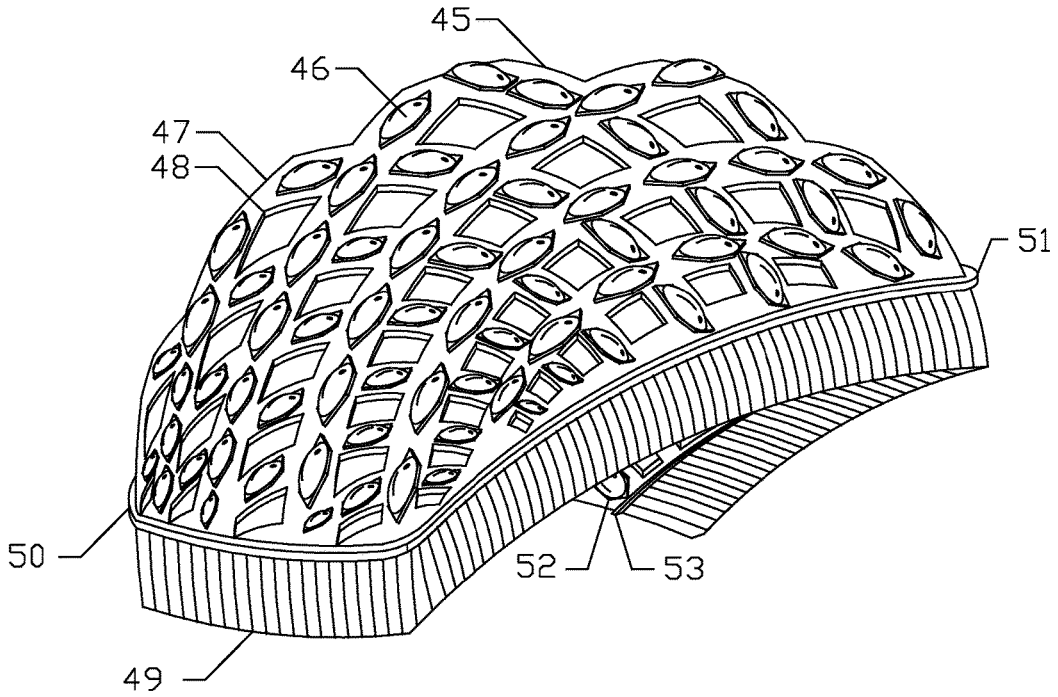
FIG. 7A shows a schematic view of an independent inner layer disposed at a mid point inside the pressurizable and ventable outer balloon shell.
Figure 7B:
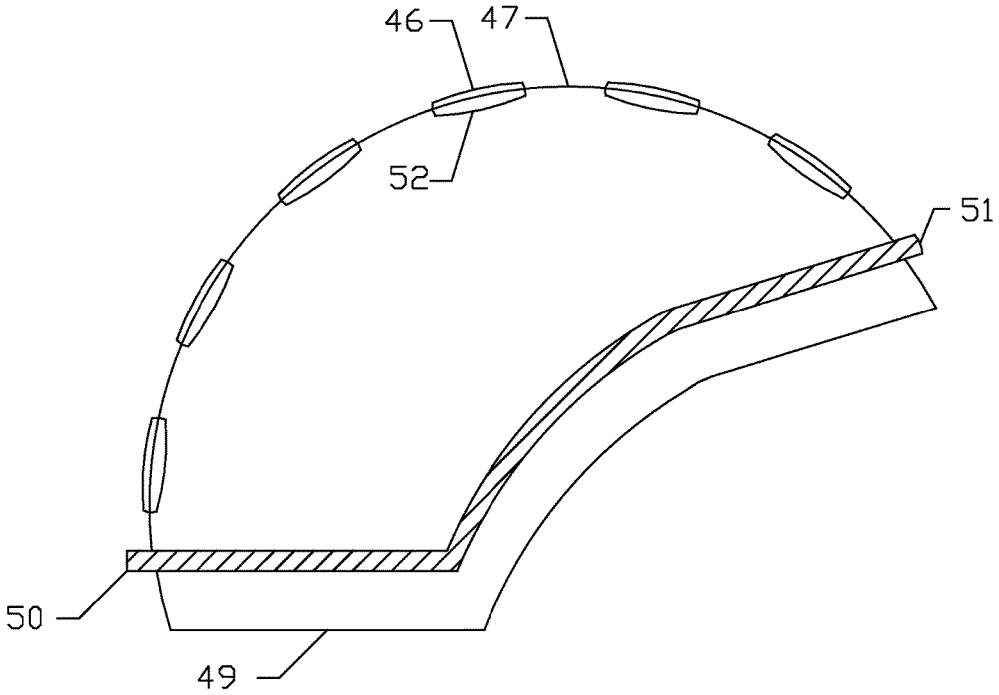
FIG. 7B shows a schematic profile view of the independent inner layer.

FIGS. 7A and 7B show schematic views of an independent inner layer 47 disposed at a mid point inside the pressurizable and ventable outer balloon shell, which comprises a dome portion 45, a plurality of ventable gas cells 46 attached on an outer surface, a plurality of ventable gas cells 52 attached on an inner surface of the independent inner layer 47, a plurality of fenestrations 48, a ruffled free-ended circumferential margin 49, an occipital portion of an outer circumferential ridge 50, a frontal portion of the outer circumferential ridge 51 and an inner circumferential ridge 53. Referring to FIG. 5D, the independent inner layer 47 comprises two outer layers which the ventable gas cells are attached to, and a mid layer intercalated in between the two outer layers.

Figure 8A:
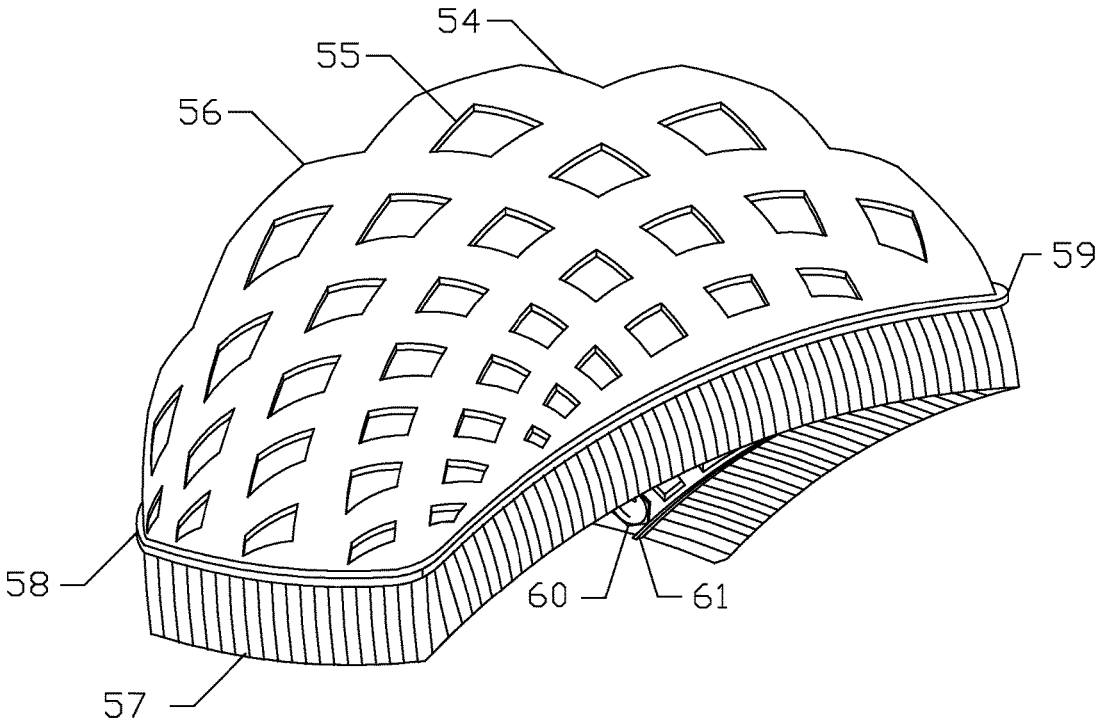
FIG. 8A shows a schematic view of an independent inner layer close to an inner wall of the pressurizable and ventable outer balloon shell.
Figure 8B:
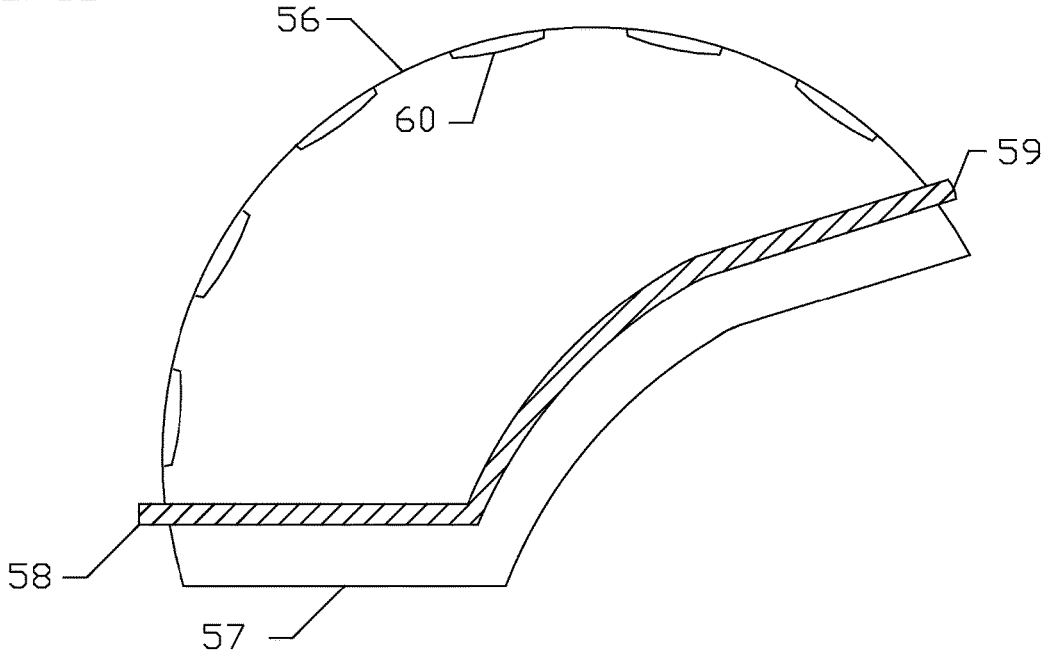
FIG. 8B shows a schematic profile view of the independent inner layer.

FIGS. 8A and 8B show schematic views of an independent inner layer 56 close to an inner wall of the pressurizable and ventable outer balloon shell shown in FIG. 4C, provided in a configuration with ventable gas cells 60 attached on an inner surface of said independent inner layer 56, which comprises a plurality of fenestrations 55, a dome portion 54, a ruffled free-ended circumferential margin 57, an occipital portion of an outer circumferential ridge 58, a frontal portion of the outer circumferential ridge 59 and an inner circumferential ridge 61. The inner circumferential ridge 61 is provided above the ruffled free-ended circumferential margin 57, which is configured to be anchored to the ballooned rim by the corresponding circumferential ridge 28 disposed on the inner surface of the ballooned rim having the internal space 25 shown in FIG. 4B. The outer circumferential ridge 58-59 is provided above the ruffled free-ended circumferential margin 57, which is configured to be anchored by a corresponding circumferential ridge of an adjacent independent inner layer overlying the independent inner layer 56. A vertical height of the circumferential ridge 61 of the independent inner layer 56 is configured to be higher than a vertical height of the ventable gas cell 60 attached to the independent inner layer 56, so as to provide a non-contact space between the inner surface of the inner wall 26 of the pressurizable and ventable outer balloon shell shown in FIG. 4C and the independent inner layer 56.

Figure 9:
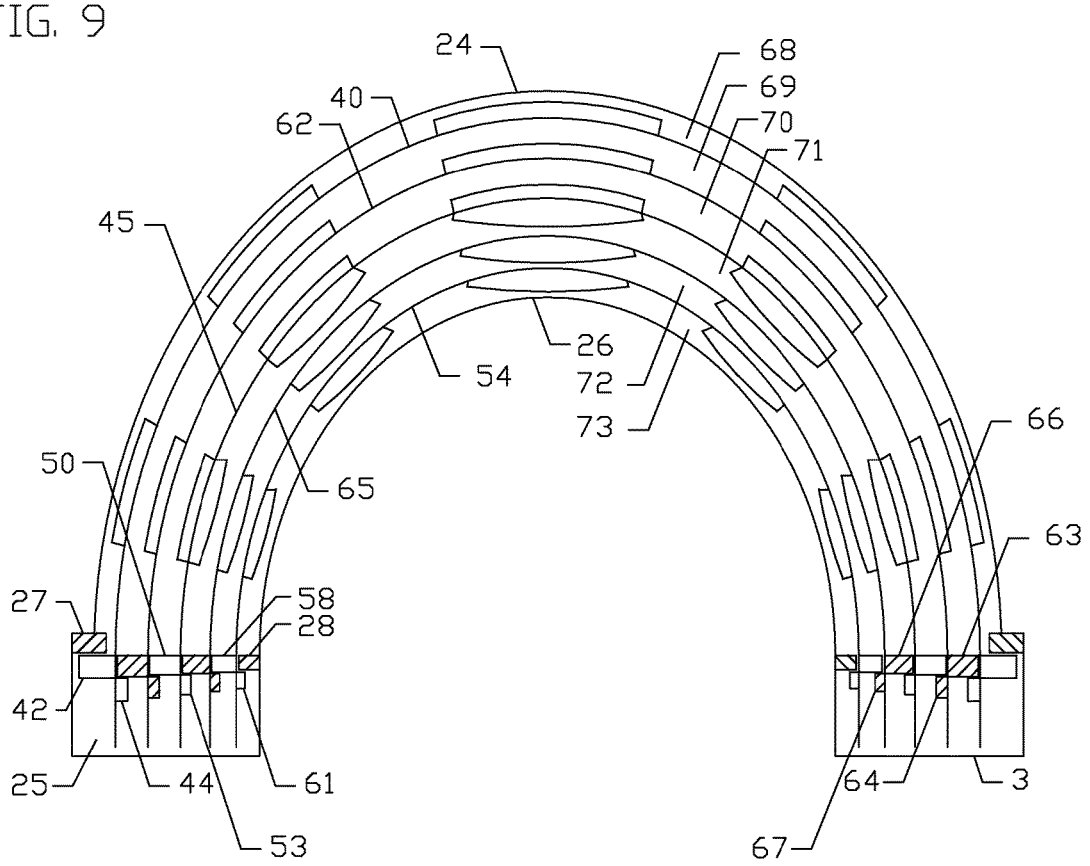
FIG. 9 shows a schematic coronal outline view of the pressurizable and ventable outer balloon shell having a plurality of independent inner layers concentrically stacked up inside the pressurizable and ventable outer balloon shell.

FIG. 9 shows a schematic coronal outline view of the pressurizable and ventable outer balloon shell having the outer wall 24, the inner wall 26, the lower ballooned rim 3 and the internal space 25. The independent inner layer 45 is disposed at the mid point inside the internal space 25, which comprises ventable gas cells on both outer and inner surfaces of said independent inner layer 45. Independent inner layers 40 and 62 are concentrically stacked up in between the outer wall 24 and the independent inner layer 45. Independent inner layers 54 and 65 are concentrically stacked up in between the inner wall 26 and the independent inner layer 45. A first pressure zone 68 is created between the outer wall 24 of the pressurizable and ventable outer balloon shell and the independent inner layer 40; a second pressure zone 69 between the independent inner layers of 40 and 62; a third pressure zone 70 between the independent inner layers of 62 and 45; a fourth pressure zone 71 between the independent inner layers of 45 and 65; a fifth pressure zone 72 between the independent inner layers of 65 and 54; a sixth pressure zone 73 between the independent inner layer of 54 and the inner wall 26 of the pressurizable and ventable outer balloon shell. The independent inner layers 40 and 62 are polarized with ventable gas cells attached to the outer layer comprising the high impedance thermoplastic elastomer; the independent inner layers 54 and 65 are polarized with ventable gas cells attached to the inner layer comprising the high impedance thermoplastic elastomer.

In FIG. 9, the circumferential ridge 27 of the pressurizable and ventable outer balloon shell is disposed on the inner surface of the outer wall 24 and the circumferential ridge 28 is disposed on the inner surface of the inner wall 26. The outer circumferential ridge 42 of the independent inner layer 40 is anchored down by the circumferential ridge 27; the inner circumferential ridge 44 anchored down by an outer circumferential ridge 63 of the independent inner layer 62; an inner circumferential ridge 64 of the independent inner layer 62 anchored down by the outer circumferential ridge 50 of the independent inner layer 45; an inner circumferential ridge 53 of the independent inner layer 45 anchored down by an outer circumferential ridge 66 of the independent inner layer 65; an inner circumferential ridge 67 of the independent inner layer 65 anchored down by the outer circumferential ridge 58 of the independent inner layer 54; the inner circumferential ridge 61 of the independent inner layer 54 anchored down by the circumferential ridge 28 of the pressurizable and ventable outer balloon shell. This series of anchoring of the independent inner layers by the circumferential ridges is configured to immobilize the ruffled free-ended circumferential margin of said independent inner layers inside the ballooned rim of the pressurizable and ventable outer balloon shell and to provide the pressurizable and ventable outer balloon shell with a plurality of non-contact pressure zones inside said pressurizable and ventable outer balloon shell.

FIG. 10A-10C show schematic views of the ventable gas cell which comprises the broad base 30 and the semi-elliptical dome 31 which is fixedly glued to the broad base 30, so as to form a distensible space 74. There is provided the gas vent slit 32 along a longitudinal axis of the semi-elliptical dome 31 and the gas intake opening 33 on one side of the semi-elliptical dome 31. The gas intake opening 33 is closed and opened by an one-way valve 34 which is disposed on an undersurface of the semi-elliptical dome 31. The semi-elliptical dome 31 is made as a two-ply structure having an outer ply bonded with an inner ply under heat to form an inseparable sheet. In FIG. 10D, the magnified profile outline view of the gas vent slit 32 in a closed configuration shows an offset configuration of the slit, with an outer slit 77 separate by a distance from an inner slit 80 in a way that an outer ply 75 covers the inner slit 80 of an inner ply 79 for the offset distance between the outer slit 77 and the inner slit 80. The outer ply 75-76 is made of a first thermoplastic elastomer having a higher Shore scale hardness than that of a second thermoplastic elastomer of the inner ply 78-79. On insufflation of a gas into the ventable gas cell, the inner ply 78-79 could be stretched but the outer ply 75-76 may not be stretchable by a pressurized gas inside the ventable gas cell, based on their difference in the hardness. The offset configuration of the two slits 77 and 80 is to let the semi-elliptical dome 32 distended by the pressurized gas which cannot escape through the inner slit 80 until the outer slit 77 is cracked open together with opening of the inner slit 80, as illustrated in FIG. 10F. FIG. 10E shows a schematic profile outline view of an independent inner layer 83 having a ventable gas cell 82 stacked up on top of another independent inner layer 85 having a ventable gas cell 84. Upon an impact 86 and 87 at an angle to the ventable gas cells 82 and 84, an independent inner layers 81 above the ventable gas cell 82 and the independent inner layer 83 press down the ventable gas cells 82 and 84, respectively, opening the slit 32 of the ventable gas cells 82 and 84 thereby releasing the pressurized gas trapped inside the distensible space 74.

Figure 11A:
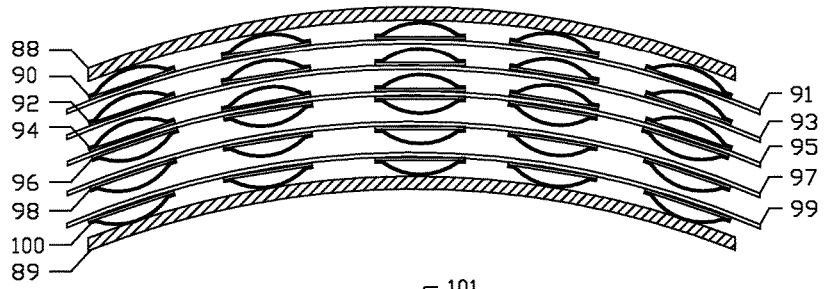
FIG. 11A shows a schematic profile outline view of a section of the pressurizable and ventable outer balloon shell enclosing a plurality of stacked-up independent inner layers.

FIG. 11A shows a schematic profile outline view of a section of the pressurizable and ventable outer balloon shell with an outer wall 88 and inner wall 89 enclosing a plurality of stacked-up independent inner layers 91, 93, 95, 97 and 99. The independent inner layers 91 and 93 have ventable gas cells 90 and 92 attached to an outer surface of said independent inner layers 91 and 93, respectively, pointing toward the outer wall 88. The independent inner layers 97 and 99 have ventable gas cells 98 and 100 attached to an inner surface of said independent inner layers 97 and 99, respectively, pointing toward the inner wall 89. The independent inner layer 95 located at a mid point inside the pressurizable and ventable outer balloon shell has ventable gas cells 94 attached to an outer surface and 96 attached to the inner surface of said independent inner layer 95. An overall Shore scale hardness is highest with the independent inner layer 95 and decreases to lowest with the independent inner layer 91 in an outbound direction; for an inbound direction, the overall Shore scale hardness decreases to lowest with the independent inner layer 99 from the independent inner layer 95. The overall Shore scale hardness of the outer and inner walls 88 and 89 of the pressurizable and ventable outer balloon shell is lower than that of the independent inner layers 91 and 99, respectively.

Figure 11B:
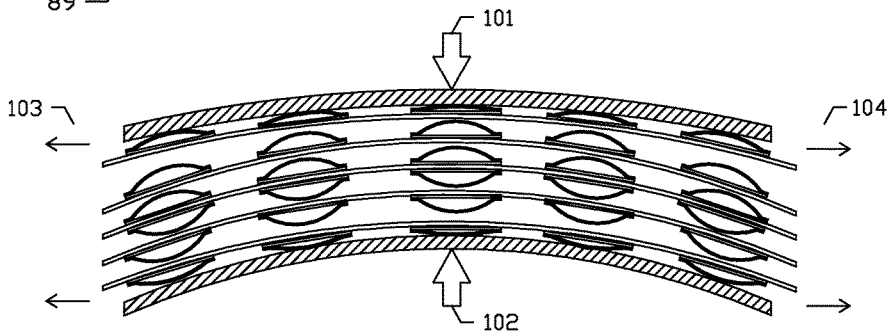
FIG. 11B depicts a first step of a collapse of a first pressure zone along with collapse of a group of ventable gas cells of a first independent inner layer close to a wall of the pressurizable and ventable outer balloon shell upon the impact.

FIG. 11B depicts a first step of a collapse of a first pressure zone established between the outer wall 88 and the independent inner layer 91, and between the inner wall 89 and the independent inner layer 99. When there come mechanical waves 101 of a blunt trauma to the pressurizable and ventable outer balloon shell, the first pressure zone between the outer wall 88 and the independent inner layer 91 collapses along with collapse of a group of ventable gas cells 90 of the independent inner layer 91 by the mechanical waves 101 of the blunt trauma to the outer wall 88 pushing out a gas away from an area of the impact in directions of 103 and 104. Since the blunt trauma to the head is a bidirectional process for the mechanical waves, there is a group of separate mechanical waves 102 coming from a head of a recipient in an opposite direction at the time of delivery of the mechanical waves 101 toward the head. Upon delivery of the mechanical waves 102 to the inner wall 89 of the pressurizable and ventable outer balloon shell, the first pressure zone between the inner wall 89 and the independent inner layer 99 collapses along with collapse of a group of ventable gas cells 100 of the independent inner layer 99 by the mechanical waves 102 from the head to the inner wall 89 similarly pushing out the gas away from an area of delivery of the mechanical waves in directions of 103 and 104. Amplitudes of the mechanical waves 101 and 102 will be reduced across both the independent inner layers 91 and 99 based on the at least two-layered structure shown in FIG. 5C, respectively. Venting of the gas from the ventable gas cells 90 and 100 is configured to dissipate the amplitudes of the mechanical waves doubled up by in-phase reflected mechanical waves joining incident mechanical waves inside the pressure zone between the outer wall 88 and the independent inner layer 91, and between the inner wall 89 and the independent inner layer 99.

Figure 11C:
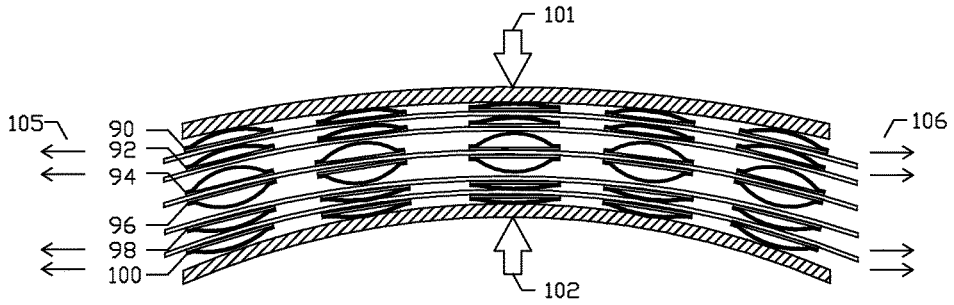
FIG. 11C shows a second step of a collapse of a second pressure zone along with collapse of a group of ventable gas cells of a second independent inner layer.

FIG. 11C shows a second step of a collapse of a second pressure zone established between the independent inner layer 91 and the independent inner layer 93. Since the overall Shore scale hardness of the independent inner layer 93 is higher than that of the independent inner layer 91, the first pressure zone between the outer wall 88 and the independent inner layer 91 is configured to completely collapse by the mechanical waves 101 before the second pressure zone between the independent inner layer 91 and the independent inner layer 93 discharges the gas completely. It similarly applies to the independent inner layer 97 which has a higher Shore scale hardness than the independent inner layer 99. When the mechanical waves 101 are transmitted to the second pressure zone, the second pressure zone collapses along with collapse of a group of ventable gas cells 92 of the independent inner layer 93 by the mechanical waves 101 pushing out the gas away from an area of the impact in directions of 105 and 106. Upon delivery of the mechanical waves 102 to a second pressure zone between the independent inner layer 99 and the independent inner layer 97 of the pressurizable and ventable outer balloon shell, the second pressure zone collapses along with collapse of a group of ventable gas cells 98 of the independent inner layer 97 by the mechanical waves 102 similarly pushing out the gas away from an area of delivery of the mechanical waves in directions of 105 and 106. Reduction of the amplitudes of the mechanical waves 101 and 102 continues across the independent inner layers 93 and 97, and dissipation of the doubled-up mechanical waves in the second pressure zone occurs by venting of the gas from the ventable gas cells 92 and 98.

Figure 11D:
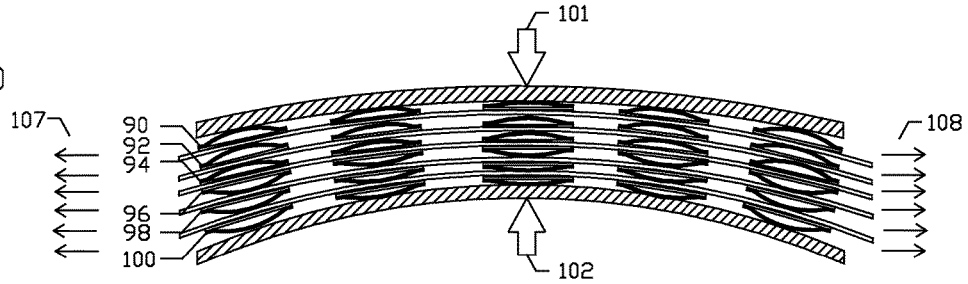
FIG. 11D illustrates a collapse of a third pressure zone along with collapse of a group of ventable gas cells of a mid point independent inner layer.

FIG. 11D illustrates a collapse of a third pressure zone established between the independent inner layers 93 and 95, and between the independent inner layers 97 and 95. Since the overall Shore scale hardness of the mid-point independent inner layer 95 is the highest, the first and second pressure zones are configured to completely collapse by the mechanical waves 101 before the third pressure zone between the independent inner layers 93 and 95, and between the independent inner layers 97 and 95 discharges the gas completely. When the mechanical waves 101 and 102 are transmitted to the third pressure zone, the third pressure zone collapses along with collapse of a group of ventable gas cells 94 and 96 on both sides of the independent inner layer 95 by the mechanical waves 101 and 102, respectively, pushing out the gas away from an area of the impact in directions of 107 and 108. Across the three-layered mid-point independent inner layer 95, the mechanical waves 101 are transmitted in phase reversal toward the mechanical waves 102 directed to the mid point independent inner layer 95, and vice versa. Collision of the mechanical waves 101 and 102 in phase reversal across the mid-point independent inner layer 95 results in neutralization of the mechanical waves, which is configured to reduce the amplitudes of the mechanical waves 101 and 102. Dissipation of the doubled-up mechanical waves in the third pressure zone occurs by venting of the gas from the ventable gas cells 94 and 96.

Figure 12A:
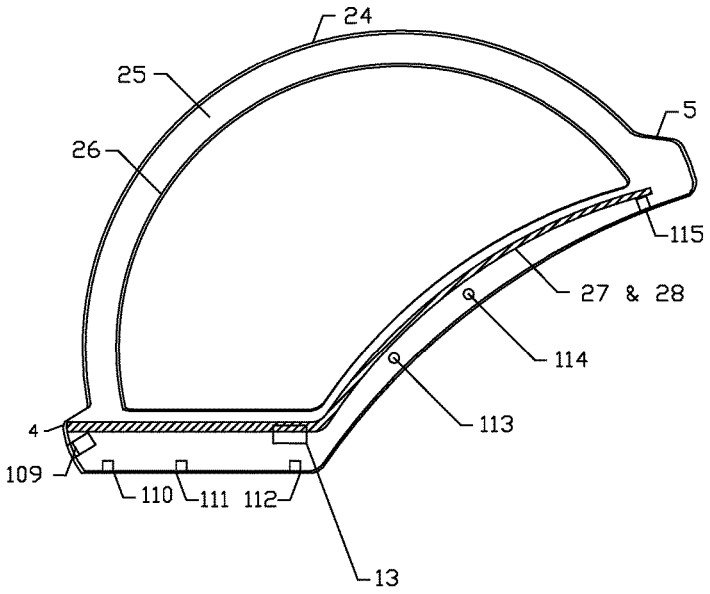
FIG. 12A shows a schematic profile outline view of the pressurizable and ventable outer balloon shell having a pressurized-gas intake valve, pressure-triggerable gas release valves and a pressure sensor device.
Figure 12B:
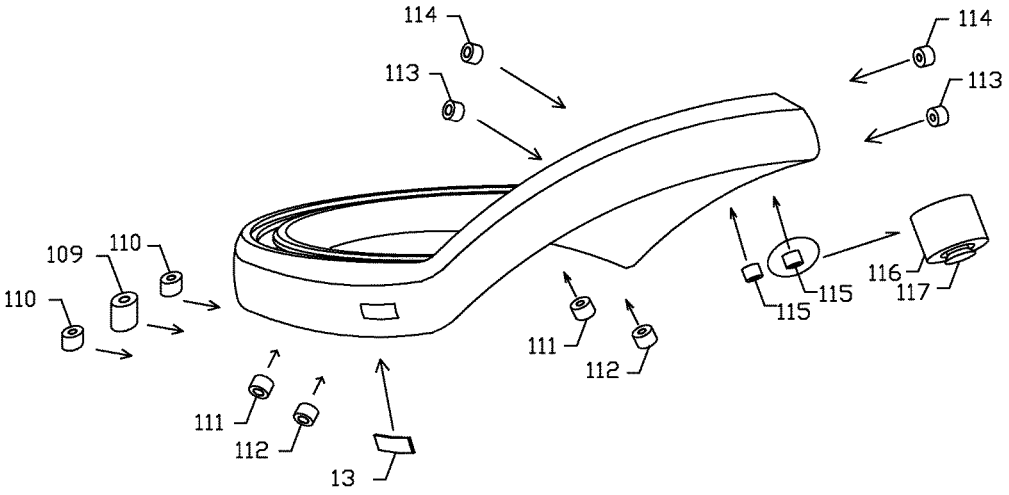
FIG. 12B shows a schematic three-dimensional view of the ballooned rim of the pressurizable and ventable outer balloon shell and the pressurized-gas intake valve, pressure-triggerable gas release valves and the pressure sensor device.

FIG. 12A shows a schematic profile outline view of the pressurizable and ventable outer balloon shell having a Schrader-type gas intake valve 109 embedded in a lower wall of the ballooned rim 3 below the occipital portion 4 into the internal space 25, spring-operated pressure release gas valves 110-112 disposed in the lower wall of the ballooned rim 3, and the pressure sensor device 13 disposed on the ballooned rim 3. Additional spring-operated pressure release gas valves 113-114 and 115 are disposed in a temporal portion of the ballooned rim and the frontal ballooned rim 5, respectively. The circumferential ridges 27 and 28 are located above the devices of the gas intake valve, the pressure release gas valves and the pressure sensor device of the ballooned rim 3. FIG. 12B shows a schematic three-dimensional view of the ballooned rim with the Schrader-type gas valve, the spring-operated pressure release gas valves and the pressure sensor device, with an upper portion of the lower ballooned rim exposed. One frontal spring-operated pressure release gas valve 115 is shown magnified, having a cylindrical configuration with an outer cylinder 116 and a valve 117 which is pushable by a spring and quick-release.

Figure 13A:
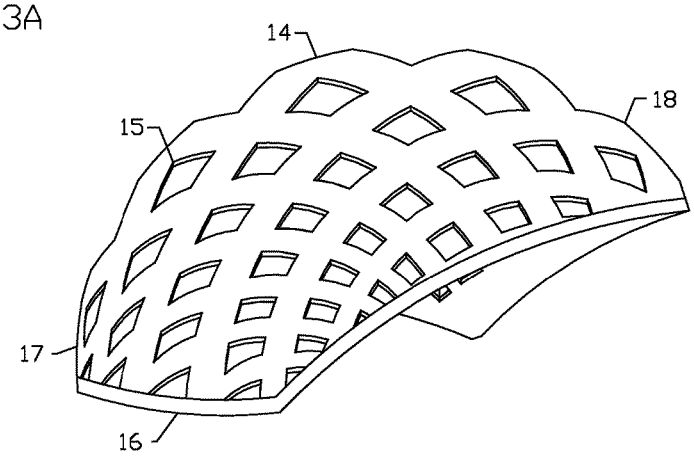
FIG. 13A shows a schematic view of the inner hard shell.
Figure 13C:
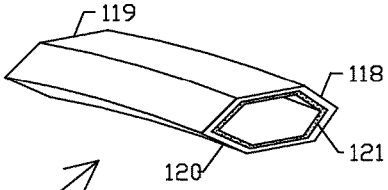
FIG. 13C shows a schematic magnified view of a tubular padding.
Figure 13B:
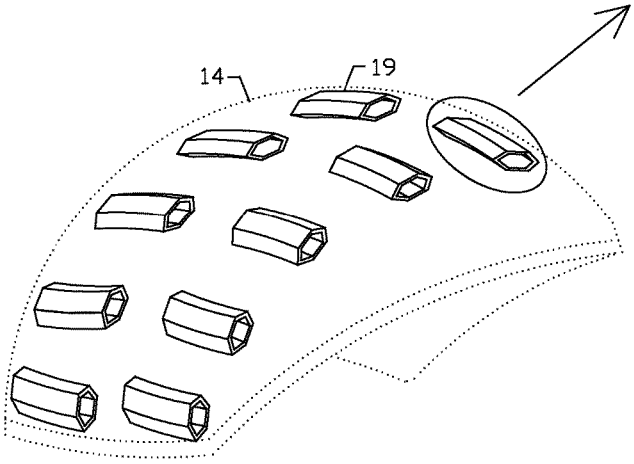
FIG. 13B shows a schematic view of a plurality of tubular paddings.

FIG. 13A shows a schematic view of the inner hard shell which comprises the dome portion 14, a plurality of the fenestrations 15 for ventilation, the attachment rim 16 configured to adherently fasten the inner hard shell to the inner circumferential rim margin of the dome portion 11 of the pressurizable and ventable outer balloon shell of FIG. 2B, the occipital portion 17 and the frontal portion 18. The inner hard shell comprises at least two layers with an outer layer made of an impact resistant polymer such as carbon-fiber-reinforced-polymer or glass-fiber reinforced nylon and an inner layer made of thermoplastic elastomers having a lower Shore scale hardness than that of the outer layer. The fenestrations 15 correspond to fenestrations of the inner wall of the pressurizable and ventable outer balloon shell. FIG. 13B shows a schematic view of a plurality of tubular paddings 19 detachably attached to an inner surface of the inner hard shell, which is configured to push out an air from a space between the head of the recipient of the blunt trauma and the inner surface of the inner hard shell at a time of the impact of the blunt trauma to the head to reduce the doubling-up of amplitudes of the mechanical waves and to ventilate the space. FIG. 13C shows a schematic magnified view of a tubular padding provided in a hexagonal configuration along a longitudinal axis of said tubular padding having an open end 118 and 119, wherein each tubular padding comprises an outer layer 120 made of a first thermoplastic elastomer having a lower Shore scale hardness than an inner layer 121 made of a second thermoplastic elastomer. The tubular padding 19 is configured to be compressible on a longitudinal side wall.

It is to be understood that the aforementioned description of the apparatus is simple illustrative embodiments of the principles of the present invention. Various modifications and variations of the description of the present invention are expected to occur to those skilled in the art without departing from the spirit and scope of the present invention. Therefore the present invention is to be defined not by the aforementioned description but instead by the spirit and scope of the following claims.

What is claimed is:

1. A mechanical-waves dissipating protective headgear apparatus, comprising:

a pressurizable and ventable outer balloon shell enclosing a plurality of independent inner layers having a plurality of ventable gas cells fixedly attached to each independent inner layer, an inner hard shell, and a plurality of tubular paddings; wherein the pressurizable and ventable outer balloon shell comprises a dome having a pressurizable space in said dome and a ballooned rim having a pressurizable space in said ballooned rim, wherein the pressurizable space of the ballooned rim adjoins a circumferential margin of the pressurizable space of the dome, wherein the pressurizable and ventable outer balloon shell fixedly encases the inner hard shell, wherein the pressurizable and ventable outer balloon shell is provided as an airtight shell reversibly pressurizable by a pressurized gas, wherein the pressurizable and ventable outer balloon shell is configured to be reversibly and depressibly deformable by an impact of a blunt trauma, and wherein the pressurizable and ventable outer balloon shell is configured to release the pressurized gas to an atmosphere upon said impact of said blunt trauma to said pressurizable and ventable outer balloon shell; the inner hard shell, provided in a single-piece dome configuration, wherein the inner hard shell comprises a plurality of fenestrations aligned with the fenestrations of the pressurizable and ventable outer balloon shell so as to reduce resonance of mechanical waves of the impact of the blunt trauma underneath the inner hard shell, wherein the inner hard shell comprises an outer thermoplastic elastomeric layer and an inner thermoplastic elastomeric layer, and wherein the inner hard shell is undeformable upon the impact of the blunt trauma; and the tubular padding, provided in an open hexagonal tubular configuration, wherein the tubular padding comprises an outer layer of the tubular padding made of a first thermoplastic elastomer having a lower Shore scale hardness than an inner layer of the tubular padding made of a second thermoplastic elastomer, wherein the tubular padding comprising said inner layer having the second thermoplastic elastomer attached to said outer layer having the first thermoplastic elastomer having the lower Shore scale hardness than that of said inner layer is configured to exert boundary effects on the mechanical waves of the impact of the blunt trauma so as to reduce amplitudes of the mechanical waves of the impact of the blunt trauma crossing the tubular padding, and wherein the tubular padding is configured to be disposed underneath the inner hard shell; and wherein a plurality of the independent inner layers comprise: a plurality of outer independent inner layers, a mid-point independent inner layer and a plurality of inner independent inner layers concentrically stacked up inside a pressurizable space of said pressurizable and ventable outer balloon shell;

an outer independent inner layer, provided as an at least two-layered sheet, wherein the at least two-layered sheet of said outer independent inner layer comprises a first layer of the outer independent inner layer made of a first thermoplastic elastomer and a second layer of the outer independent inner layer made of a second thermoplastic elastomer;

the mid-point independent inner layer, provided as an at least three-layered sheet, wherein the midpoint independent inner layer is disposed in between the outer and inner independent inner layers inside the pressurizable and ventable outer balloon shell, wherein the mid-point independent inner layer comprises an outer layer, a mid layer and an inner layer, wherein the outer and inner layers of the mid-point independent inner layer comprise a first thermoplastic elastomer, and wherein the mid layer of the mid-point independent inner layer comprises a second thermoplastic elastomer; and an inner independent inner layer, provided as an at least two-layered sheet, wherein the at least two-layered sheet of said inner independent inner layer comprises a first layer of the inner independent inner layer made of a first thermoplastic elastomer and a second layer of the inner independent inner layer made of a second thermoplastic elastomer.

2. The mechanical-waves dissipating protective headgear apparatus according to claim 1, wherein the pressurizable and ventable outer balloon shell is made of a combination of thermoplastic elastomers configured to have a lower Shore scale hardness than that of each independent inner layer of the plurality of the independent inner layers so as to make the pressurizable and ventable outer balloon shell be more deformable than said each independent inner layer upon the impact of the blunt trauma to the pressurizable and ventable outer balloon shell enclosing the plurality of the independent inner layers.

3. The mechanical-waves dissipating protective headgear apparatus according to claim 1, wherein the pressurizable and ventable outer balloon shell is configured to dissipate the mechanical waves of the impact of the blunt trauma to said pressurizable and ventable outer balloon shell enclosing the plurality of the independent inner layers firstly by reduction of amplitudes of the mechanical waves crossing said each independent inner layer of the plurality of the independent inner layers based on a difference in the impedance between the first and second thermoplastic elastomers of said each independent inner layer to the mechanical waves, and secondly by venting the pressurized gas from the pressurizable and ventable outer balloon shell to the atmosphere through a plurality of pressure-triggerable gas release valves of the pressurizable and ventable outer balloon shell upon the impact of the blunt trauma to said pressurizable and ventable outer balloon shell.

4. The mechanical-waves dissipating protective headgear apparatus according to claim 1, wherein a Shore scale hardness of the mid-point independent inner layer is higher than that of the plurality of the outer and inner independent inner layers.

5. The mechanical-waves dissipating protective headgear apparatus according to claim 1, wherein the pressurizable and ventable outer balloon shell further comprises:

a hard shell cover comprising a plurality of outermost thermoplastic elastomeric tiles, provided in a fenestrated configuration, wherein the outermost thermoplastic elastomeric tiles are fixedly attached to the pressurizable and ventable outer balloon shell, wherein the outermost thermoplastic elastomeric tiles are configured to have a higher Shore scale hardness than said pressurizable and ventable outer balloon shell so as to provide the outermost thermoplastic elastomeric tiles with impact resistance without material failure, and wherein the outermost thermoplastic elastomeric tiles are configured to accommodate regional depressive deformation of the pressurizable and ventable outer balloon shell upon the impact of the blunt trauma to the pressurizable and ventable outer balloon shell.

6. The mechanical-waves dissipating protective headgear apparatus according to claim 1, wherein the pressurizable and ventable outer balloon shell further comprises:

the pressurizable space inside the pressurizable and ventable outer balloon shell, wherein the pressurizable space is configured to enclose the plurality of the independent inner layers in a concentrically stacked-up configuration, wherein the pressurized space is pressurized by the pressurized gas above via a pressurized gas intake valve of the pressurizable and ventable outer balloon shell, and wherein the pressurized space is configured to vent the pressurized gas from the pressurized space to the atmosphere via the plurality of the pressure-triggerable gas release valves of the pressurizable and ventable outer balloon shell upon the impact of the blunt trauma to the pressurizable and ventable outer balloon shell.

7. The mechanical-waves dissipating protective headgear apparatus according to claim 1, wherein the pressurizable and ventable outer balloon shell further comprises:

wherein the ballooned rim is configured to anchor said each independent inner layer having the plurality of the ventable gas cells to said ballooned rim, and wherein the ballooned rim is configured to enclose a ruffled free end of said each independent inner layer.

8. The mechanical-waves dissipating protective headgear apparatus according to claim 1, wherein the pressurizable and ventable outer balloon shell further comprises:

the pressurized gas intake valve, embedded thereof in the ballooned rim of the pressurizable and ventable outer balloon shell; and the plurality of the pressure-triggerable gas release valves embedded thereof in the ballooned rim, wherein a pressure-triggerable gas release valve is configured in a spring-operated pressure release valve, and wherein the pressure-triggerable gas release valve is configured to release the pressurized gas pressurized above a predetermined set pressure limit of the pressure-triggerable gas release valve from the the pressurizable and ventable outer balloon shell to the atmosphere.

9. The mechanical-waves dissipating protective headgear apparatus according to claim 1, wherein the inner hard shell further comprises:

the outer thermoplastic elastomeric layer of the inner hard shell tightly bonded to the inner thermoplastic elastomeric layer of the inner hard shell, wherein the outer thermoplastic elastomeric layer of the inner hard shell comprises an impact resistant polymer, wherein the inner thermoplastic elastomeric layer of the inner hard shell comprises a thermoplastic elastomer having a lower Shore scale hardness than that of the outer thermoplastic elastomeric layer of the inner hard shell, and wherein the inner hard shell comprising said outer thermoplastic elastomeric layer tightly bonded to said inner thermoplastic elastomeric layer having the lower Shore scale hardness than that of said outer thermoplastic elastomeric layer is configured to exert the boundary effects on the mechanical waves of the impact of the blunt trauma so as to reduce amplitudes of the mechanical waves of the impact of the blunt trauma crossing the inner hard shell.

10. The mechanical-waves dissipating protective headgear apparatus according to claim 1, wherein the outer independent inner layer further comprises:

the first layer of the at least two-layered sheet of the outer independent inner layer, wherein the first layer of the at least two-layered sheet of the outer independent inner layer is configured to have a higher impedance to the mechanical waves than that of the second layer of the at least two-layered sheet of the outer independent inner layer.

11. The mechanical-waves dissipating protective headgear apparatus according to claim 1, wherein the mid-point independent inner layer further comprises:

the outer layer of the at least three-layered sheet of the mid-point independent inner layer, wherein the outer layer of the at least three-layered sheet of the mid-point independent inner layer is configured to have a higher impedance to the mechanical waves than that of the mid layer of the at least three-layered sheet of the mid-point independent inner layer;

the mid layer of the at least three-layered sheet of the mid-point independent inner layer, wherein the mid layer of the at least three-layered sheet of the mid-point independent inner layer is configured to have a lower impedance to the mechanical waves than that of the outer and inner layers of the at least three-layered sheet of the mid-point independent inner layer; and the inner layer of the at least three-layered sheet of the mid-point independent inner layer, wherein the inner layer of the at least three-layered sheet of the mid-point independent inner layer is configured to have a higher impedance to the mechanical waves than that of the mid layer of the at least three-layered sheet of the mid-point independent inner layer.

12. The mechanical-waves dissipating protective headgear apparatus according to claim 1, wherein the inner independent inner layer further comprises:

the first layer of the at least two-layered sheet of the inner independent inner layer, wherein the first layer of the at least two-layered sheet of the inner independent inner layer is configured to have a higher impedance to the mechanical waves than that of the second layer of the at least two-layered sheet of the inner independent inner layer.

13. The mechanical-waves dissipating protective headgear apparatus according to claim 1, wherein the independent inner layers further comprise:

the plurality of the ventable gas cells, arranged in a mosaic configuration, wherein the plurality of the ventable gas cells are fixedly attached to an outer surface of the outer independent inner layer, wherein the plurality of the ventable gas cells are fixedly attached to an outer surface of the outer layer of the mid-point independent inner layer and to the inner surface of the inner layer of the mid-point independent inner layer, and wherein the plurality of the ventable gas cells are fixedly attached to an inner surface of the inner independent inner layer facing the inner wall of the pressurizable and ventable outer balloon shell; and a ventable gas cell of the plurality of the ventable gas cells, wherein the ventable gas cell is provided in a configuration of a broad base fixedly glued to a two-ply deformable semi-elliptical dome so as to produce a reversibly closable gas space, wherein the ventable gas cell is configured to maintain a pressure of the pressurized gas inside said ventable gas cell equal to a pressure of said pressurized gas outside said ventable gas cell in the pressurizable and ventable outer balloon shell, wherein the ventable gas cell is configured to reversibly retain the pressurized gas inside said ventable gas cell by tight closing up a two-ply offset gas vent slit of said semi-elliptical dome, and wherein the ventable gas cell is configured to release said pressurized gas from said ventable gas cell by opening up the two-ply offset gas vent slit of said semi-elliptical dome.

14. The mechanical-waves dissipating protective headgear apparatus according to claim 1, wherein the independent inner layers further comprise:

a plurality of fenestrations, wherein the fenestrations are disposed therethrough the outer independent inner layer in between the plurality of the ventable gas cells, wherein the fenestrations are disposed therethrough the mid-point independent inner layer in between the plurality of the ventable gas cells, wherein the fenestrations are disposed therethrough the inner independent inner layer in between the plurality of the ventable gas cells, and wherein the fenestrations are configured to be aligned with the fenestrations of the pressurizable and ventable outer balloon shell.

15. The mechanical-waves dissipating protective headgear apparatus according to claim 1, wherein the independent inner layers further comprise:

the ruffled free end, wherein the ruffled free end extends from a circumferential edge of said each independent inner layer for a length, wherein the ruffled free end is configured to reduce amplification of an amplitude of the mechanical waves across said each independent inner layer.

* * * * *